US012130051B2

(12) United States Patent
Zhao et al.

(10) Patent No.: US 12,130,051 B2
(45) Date of Patent: Oct. 29, 2024

(54) AIR SOURCE HEAT PUMP SYSTEM AND DEFROSTING CONTROL METHOD THEREOF

(71) Applicant: QINGDAO HISENSE HITACHI AIR-CONDITIONING SYSTEMS CO., LTD., Shandong (CN)

(72) Inventors: Dongfang Zhao, Shandong (CN); Yongkun Gao, Shandong (CN); Min Liu, Shandong (CN)

(73) Assignee: QINGDAO HISENSE HITACHI AIR-CONDITIONING SYSTEMS CO., LTD., Shandong (CN)

( * ) Notice: Subject to any disclaimer, the term of this patent is extended or adjusted under 35 U.S.C. 154(b) by 305 days.

(21) Appl. No.: 17/562,376

(22) Filed: Dec. 27, 2021

(65) Prior Publication Data

US 2022/0120472 A1 Apr. 21, 2022
US 2023/0132393 A9 Apr. 27, 2023

Related U.S. Application Data

(63) Continuation-in-part of application No. PCT/CN2020/111548, filed on Aug. 27, 2020.

(30) Foreign Application Priority Data

Jul. 30, 2019 (CN) ..... 201910698878.X
Jul. 30, 2019 (CN) ..... 201921219917.5

(51) Int. Cl.
*F25B 47/02* (2006.01)
*F24H 4/04* (2006.01)

(52) U.S. Cl.
CPC ..... *F24H 4/04* (2013.01); *F25B 47/02* (2013.01)

(58) Field of Classification Search
CPC ..... F24F 4/04; F25B 47/02; F25B 2400/13; F25B 2400/0411
See application file for complete search history.

(56) References Cited

U.S. PATENT DOCUMENTS 4,766,734 A * 8/1988 Dudley ..... F25B 47/022 62/238.7
6,418,737 B1 7/2002 Kuroki et al.
(Continued)

FOREIGN PATENT DOCUMENTS

CN 201293456 Y 8/2009
CN 101706186 A 5/2010
(Continued)

OTHER PUBLICATIONS

International Search Report and Written Opinion issued in corresponding International Application No. PCT/CN2020/111548 dated Nov. 25, 2020, with English translation.

*Primary Examiner* — David J Teitelbaum
(74) *Attorney, Agent, or Firm* — Morgan, Lewis & Bockius LLP

(57) ABSTRACT

An air source heat pump system includes at least one heat pump sub-system and at least one water tank. Each heat pump sub-system includes a refrigerant circulation path and a water supply circulation path. The refrigeration circulation path includes a compressor, a first heat exchanger, a first throttling device, and an evaporator that are sequentially connected to one another. The water supply circulation path includes a first supply pipe, a second supply pipe, a return pipe, and a waterway control valve. The first supply pipe and the second supply pipe are each communicated with an end of the first heat exchanger through the waterway control valve, and the return pipe is communicated with another end of the first heat exchanger. The return pipe is communicated with a water inlet of a corresponding water tank, and the
(Continued)

second supply pipe is communicated with a water outlet of the corresponding water tank.

17 Claims, 10 Drawing Sheets

(56) References Cited

U.S. PATENT DOCUMENTS

| | | | | |
|---|---|---|---|---|
| 7,114,349 | B2 * | 10/2006 | Lifson | F25B 41/22 62/196.2 |
| 2011/0036110 | A1 * | 2/2011 | Fujimoto | F24D 17/02 62/238.7 |
| 2011/0154844 | A1 * | 6/2011 | Lee | F25B 25/005 62/278 |
| 2012/0000237 | A1 * | 1/2012 | Yamada | F25B 1/10 62/324.6 |
| 2012/0291460 | A1 * | 11/2012 | Aoyagi | F25B 40/00 62/151 |
| 2020/0348053 | A1 | 11/2020 | Dong et al. | |

FOREIGN PATENT DOCUMENTS

| | | | |
|---|---|---|---|
| CN | 104864646 | A | 8/2015 |
| CN | 105841349 | A | 8/2016 |
| CN | 106152644 | A | 11/2016 |
| CN | 107477903 | A | 12/2017 |
| CN | 105180536 | B | 2/2018 |
| CN | 107917561 | A | 4/2018 |
| CN | 105509125 | B | 6/2018 |
| CN | 108224774 | A | 6/2018 |
| CN | 108224840 | A | 6/2018 |
| CN | 108592452 | A | 9/2018 |
| CN | 210399609 | U | 4/2020 |
| KR | 10-0796452 | B1 | 1/2008 |

* cited by examiner

AIR SOURCE HEAT PUMP SYSTEM AND DEFROSTING CONTROL METHOD THEREOF

CROSS-REFERENCE TO RELATED APPLICATIONS

This application is a continuation-in-part Application of International Application No. PCT/CN2020/111548 filed on Aug. 27, 2020, which claims priority to Chinese Patent Application No. 201910698878. X filed on Jul. 30, 2019, Chinese Patent Application No. 201921219917.5 filed on Jul. 30, 2019, the entirety of each is incorporated herein by reference.

TECHNICAL FIELD

The present disclosure relates to the field of air source heat pump systems, and in particular, to an air source heat pump system and a defrosting control method thereof.

BACKGROUND

The air source heat pump system absorbs low-temperature heat in the air via a heat transfer medium, and the heat transfer medium is compressed by a compressor and in turn the low-temperature heat is converted into high-temperature heat to heat water. Compared with electric water heaters and gas water heaters, the air source heat pump system has the advantages of high efficiency and energy conservation. Since $CO_2$ is a kind of heat transfer medium in nature, the ozone depletion potential (ODP) of $CO_2$ is 0, and the global warming potential (GWP) is 1, the $CO_2$ heat pump system has a promising application prospect on occasions where the combustible and toxic are strictly limited.

SUMMARY

In an aspect, an air source heat pump system is provided. The air source heat pump system includes at least one heat pump sub-system and at least one water tank. The at least one heat pump sub-system is connected to the at least one water tank. Each heat pump sub-system includes a refrigerant circulation path and a water supply circulation path. The refrigerant circulation path includes a compressor, a first heat exchanger, a first throttling device, and an evaporator that are connected to one another in sequence. The water supply circulation path includes a first supply pipe, a second supply pipe, a return pipe, and a waterway control valve. The first supply pipe and the second supply pipe are each communicated with an end of the first heat exchanger through the waterway control valve, and the return pipe is communicated with another end of the first heat exchanger. Each water tank includes a water inlet and a water outlet. The return pipe is communicated with a water inlet of a corresponding water tank, and the second supply pipe is communicated with a water outlet of the corresponding water tank.

In another aspect, a defrosting control method for the above-mentioned air source heat pump system is provided. The air source heat pump system further includes a controller, and the first heat exchanger further includes a water inlet and a water outlet. The defrosting control method includes: in response to the controller determines that the air source heat pump system reaches a first defrosting condition, the waterway control valve controls the water inlet of the first heat exchanger to disconnect from both the first supply pipe and the second supply pipe, so that a defrosting of the evaporator is started; and in a case where the controller determines that the air source heat pump system reaches a first defrosting completion condition, the defrosting ends.

In another aspect, a defrosting control method for the above-mentioned air source heat pump system is provided. The air source heat pump system further includes a controller, and the first heat exchanger further includes a water inlet and a water outlet. The defrosting control method further includes: in response to the controller determines that the air source heat pump system reaches a second defrosting condition, the waterway control valve controls the water inlet of the first heat exchanger to communicate with the second supply pipe and to disconnect from the first supply pipe, so that a defrosting of the evaporator is started; and in a case where the controller determines that the air source heat pump system reaches a second defrosting completion condition, the waterway control valve controls the water inlet of the first heat exchanger to disconnect from the second supply pipe.

BRIEF DESCRIPTION OF THE DRAWINGS

In order to describe technical solutions in the present disclosure more clearly, the accompanying drawings to be used in some embodiments of the present disclosure will be introduced briefly below. Obviously, the accompanying drawings to be described below are merely accompanying drawings of some embodiments of the present disclosure, and a person of ordinary skill in the art can obtain other drawings according to these drawings. In addition, the accompanying drawings to be described below may be regarded as schematic diagrams, but are not limitations on an actual size of a product, an actual process of a method and an actual timing of a signal to which the embodiments of the present disclosure relate.

DETAILED DESCRIPTION

Figure 1A:
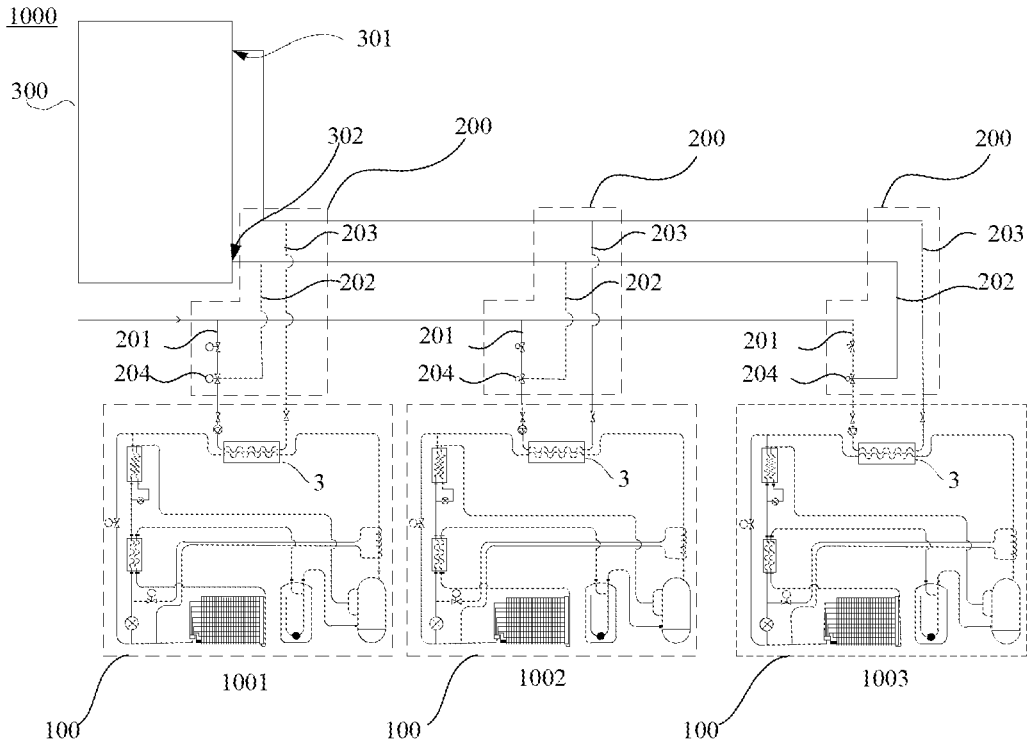
FIG. 1A is a structural diagram of a $CO_2$ heat pump system, in accordance with some embodiments.

Technical solutions in some embodiments of the present disclosure will be described clearly and completely below with reference to the accompanying drawings. Obviously, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms "first" and "second" are used for descriptive purposes only, and are not to be construed as indicating or implying relative importance or implicitly indicating the number of indicated technical features. Thus, a feature defined with "first" or "second" may explicitly or implicitly include one or more of the features. In the description of the embodiments of the present disclosure, the term "a plurality of", "the plurality of" or "multiple" means two or more unless otherwise specified.

In the description of some embodiments, the terms such as "coupled" and "connected" and derivatives thereof may be used. For example, the term "connected" may be used when describing some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The expression "at least one of A, B, and C" has a same meaning as the expression "at least one of A, B, or C", and both include the following combinations of A, B, and C: only A, only B, only C, a combination of A and B, a combination of A and C, a combination of B and C, and a combination of A, B, and C.

"A and/or B" includes the following three combinations: only A, only B, and a combination of A and B.

The use of the phrase "applicable to" or "configured to" herein means an open and inclusive language, which does not exclude devices that are applicable to or configured to perform additional tasks or steps.

Terms such as "about", "substantially" or "approximately" as used herein includes a stated value and an average value within an acceptable range of deviation of a particular value. The acceptable range of deviation is determined by a person of ordinary skill in the art in view of the measurement in question and the error associated with the measurement of a particular quantity (i.e., the limitations of the measurement system).

Some embodiments of the present disclosure provide an air source heat pump system. The air source heat pump system may use air or $CO_2$ as a refrigerant. When $CO_2$ is used as the refrigerant, the air source heat pump system is a $CO_2$ heat pump system. The present disclosure does not limit this.

Descriptions are made below by taking an example in which the air source heat pump system is the $CO_2$ heat pump system.

Figure 1B:
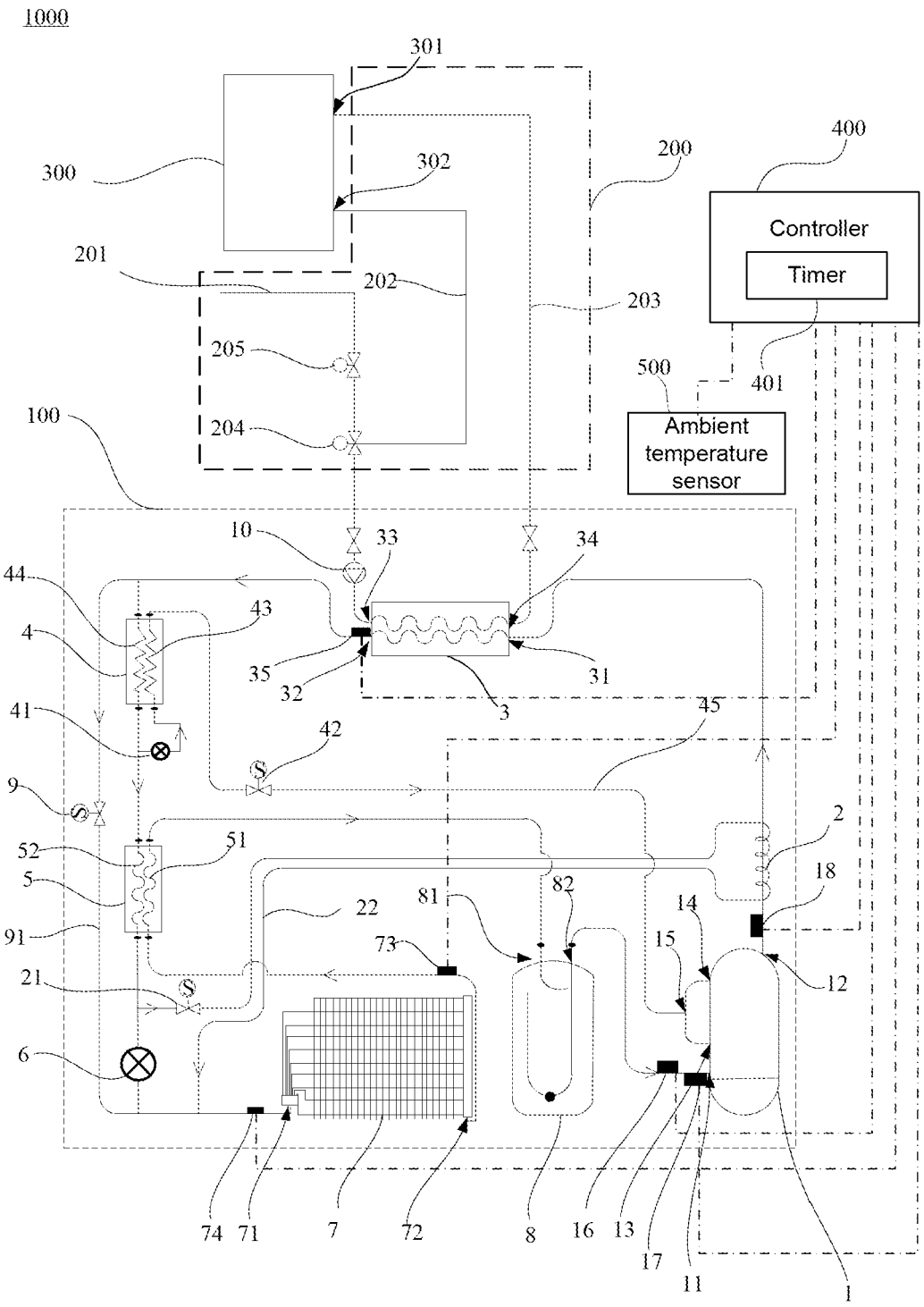
FIG. 1B is a structural diagram of another $CO_2$ heat pump system, in accordance with some embodiments.

FIG. 1A is a structural diagram of a $CO_2$ heat pump system, in accordance with some embodiments. FIG. 1B is a structural diagram of another $CO_2$ heat pump system, in accordance with some embodiments. In some embodiments, as shown in FIG. 1A, the $CO_2$ heat pump system 1000 includes a plurality of heat pump sub-systems, and the $CO_2$ heat pump system 1000 is suitable for situations where a large amount of water needs to be heated. Each heat pump sub-system includes a refrigerant circulation path 100 and a water supply circulation path 200. As shown in FIG. 1A, the plurality of heat pump sub-systems include a first heat pump sub-system 1001, a second heat pump sub-system 1002, and a third heat pump sub-system 1003. The water supply circulation paths 200 in the three heat pump sub-systems are communicated with a same water tank 300, which is not limited thereto, and the water supply circulation paths 200 in the plurality of heat pump sub-systems may be communicated with a plurality of water tanks 300 in a one-to-one correspondence.

In some embodiments, as shown in FIG. 1B, the $CO_2$ heat pump system 1000 includes one heat pump sub-system. The number of heat pump sub-systems in the $CO_2$ heat pump system is not limited in the present disclosure.

Figure 2:
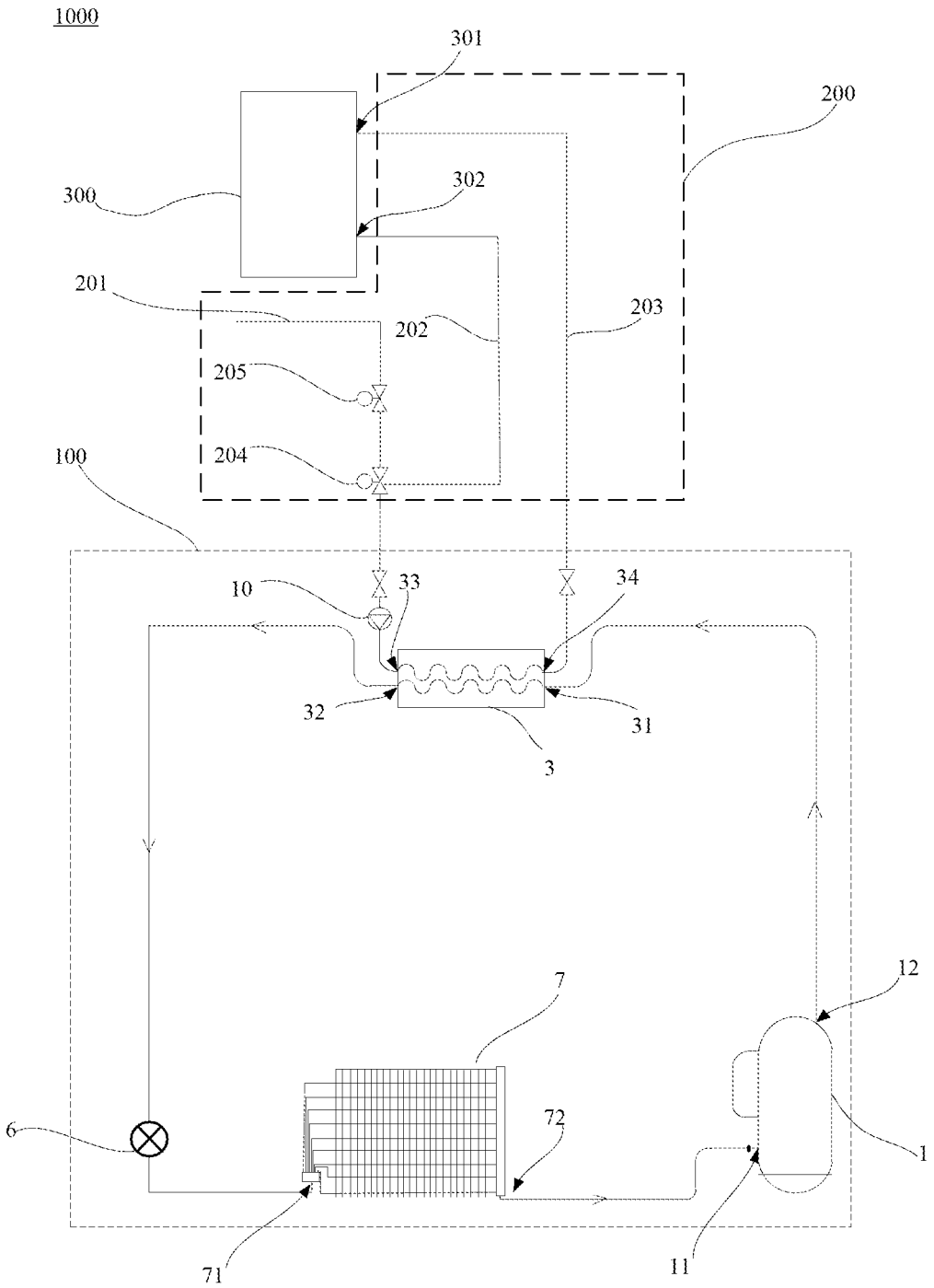
FIG. 2 is a structural diagram of yet another $CO_2$ heat pump system, in accordance with some embodiments.

FIG. 2 is a structural diagram of yet another $CO_2$ heat pump system, in accordance with some embodiments. As shown in FIG. 2, the refrigerant circulation path 100 includes a compressor 1, a first heat exchanger 3, a first throttling device 6, and an evaporator 7 that are connected to one another in sequence. The compressor 1 includes a first suction port 11 and a first exhaust port 12; the first heat exchanger 3 includes a refrigerant inlet 31 and a refrigerant outlet 32; and the evaporator 7 includes a gas inlet 71 and a gas outlet 72. The first exhaust port 12 is connected to the refrigerant inlet 31, the refrigerant outlet 32 is connected to the gas inlet 71, the first throttling device 6 is located between the refrigerant outlet 32 and the gas inlet 71, and the gas outlet 72 is connected to the first suction port 11. The first throttling device 6 is configured to convert a high-pressure refrigerant into a low-pressure refrigerant. For example, the first throttling device 6 may adopt a capillary tube or an electronic expansion valve. The refrigerant used in the refrigerant circulation path 100 is $CO_2$, and a direction indicated by arrows is a flow direction of the refrigerant.

The water supply circulation path 200 includes a cold water supply pipe 201, a hot water supply pipe 202, a return pipe 203, and a waterway control valve 204. The first heat exchanger 3 further includes a water inlet 33 and a water outlet 34, the water inlet 33 is communicated with the cold water supply pipe 201 and the hot water supply pipe 202 through the waterway control valve 204, and the water outlet 34 is communicated with the return pipe 203. The waterway control valve 204 is configured to control the water inlet 33 to communicate with the cold water supply pipe 201 and to disconnect from the hot water supply pipe 202; or to control the water inlet 33 to disconnect from the cold water supply pipe 201 and to communicate with the hot water supply pipe 202; or to control the water inlet 33 to disconnect from both the cold water supply pipe 201 and the hot water supply pipe 202. The cold water supply pipe 201 may be connected to an external water source.

The water tank 300 includes a water inlet 301 and a water outlet 302, the water inlet 301 is communicated with the return pipe 203, and the water outlet 302 is communicated with the hot water supply pipe 202.

In some embodiments, the $CO_2$ heat pump system 1000 may heat water from the external water source and inject the heated water into the water tank 300. As shown in FIG. 2, the waterway control valve 204 controls the water inlet 33 to communicate with the cold water supply pipe 201 and to disconnect from the hot water supply pipe 202. The cold water flows into the first heat exchanger 3 via the cold water supply pipe 201 through the water inlet 33; meanwhile, a high-temperature and high-pressure refrigerant is discharged from the first exhaust port 12 of the compressor 1, and enters the first heat exchanger 3 through the refrigerant inlet 31. The high-temperature and high-pressure refrigerant entering the first heat exchanger 3 transfers heat to the cold water in the first heat exchanger 3, thereby heating the cold water. The heated water flows out through the water outlet 34, and flows into the water tank 300 via the return pipe 203 through the water inlet 301, thereby achieving purposes of heating the water from the external water source and injecting the heated water into the water tank 300. The refrigerant that has undergone heat exchange in the first heat exchanger 3 flows out from the refrigerant outlet 32, flows through the first throttling device 6, enters the evaporator 7 through the gas inlet 71 for heat absorption and evaporation, finally flows out from the gas outlet 72, and returns to the compressor 1 via the first suction port 11. Thus, a heating cycle is completed.

It will be noted that in addition to the external water source, the cold water supply pipe 201 may further be communicated with the water tank 300. In a case where the cold water supply pipe 201 is communicated with the water tank 300, the water in the water tank 300 can be heated. In some embodiments, in a case where the cold water supply pipe 201 is communicated with the water tank 300, only one of the cold water supply pipe 201 and the hot water supply pipe 202 may be used, and the other may be omitted.

The refrigerant entering the evaporator 7 absorbs heat and evaporates and then returns to the compressor 1, and as a result, a temperature of a surface of the evaporator 7 is lowered. When the $CO_2$ heat pump system operates (to heat water from the external water source or to heat water in the water tank 300) under low outdoor temperature and high humidity, the surface of the evaporator 7 is frosted, resulting in a decrease in a heating capacity of the $CO_2$ heat pump system.

To this end, in some embodiments, the $CO_2$ heat pump system may also defrost the evaporator 7. As shown in FIG. 2, the waterway control valve 204 controls the water inlet 33 to communicate with the hot water supply pipe 202 and to disconnect from the cold water supply pipe 201, hot water in the water tank 300 flows out from the water outlet 302, and flows into the first heat exchanger 3 via the hot water supply pipe 202 through the water inlet 33; meanwhile, the refrigerant is discharged from the first exhaust port 12 of the compressor 1 and enters the first heat exchanger 3 through the refrigerant inlet 31. The refrigerant entering the first heat exchanger 3 absorbs the heat of the hot water in the first heat exchanger 3, so that a temperature of the refrigerant increases. Then, the first throttling device 6 is turned on, and the refrigerant discharged from the refrigerant outlet 32 flows through the first throttling device 6 and enters the evaporator 7 through the gas inlet 71 to defrost the evaporator 7. Since the refrigerant discharged from the compressor 1 can absorb the heat of the hot water when passing through the first heat exchanger 3, the temperature of the refrigerant entering the evaporator 7 increases, thereby speeding up a speed of defrosting the evaporator 7, and shortening a duration for defrosting the evaporator 7.

It will be noted that there is no inevitable relationship between a temperature of the cold water supplied by the cold water supply pipe 201 and a temperature of the hot water supplied by the hot water supply pipe 202. For example, in some cases, the temperature of the hot water supplied by the hot water supply pipe 202 may be lower than the temperature of the cold water supplied by the cold water supply pipe 201, as long as the temperature of the hot water supplied by the hot water supply pipe 202 can reach a standard for defrosting the evaporator 7. Therefore, the cold water supply pipe 201 may be referred to as a first supply pipe 201, and the hot water supply pipe 202 may be referred to as a second supply pipe 202. The cold water in the cold water supply pipe 201 may be referred to as first water, and the hot water in the hot water supply pipe 202 may be referred to as second water.

In some embodiments, the $CO_2$ heat pump system 1000 further includes a water valve 205. The water valve 205 is disposed on the cold water supply pipe 201, and is configured to control the cold water supply pipe 201 to open or close. For example, the water valve 205 is an electric valve 205. For example, the water valve 205 is an electric ball valve 205.

In some embodiments, the $CO_2$ heat pump system 1000 further includes a water pump 10. The water pump 10 is located between the waterway control valve 204 and the water inlet 33 of the first heat exchanger 3, and is configured to reduce a resistance of a pipeline between the water tank 300 and the first heat exchanger 3, so as to drive water to flow.

Figure 3:
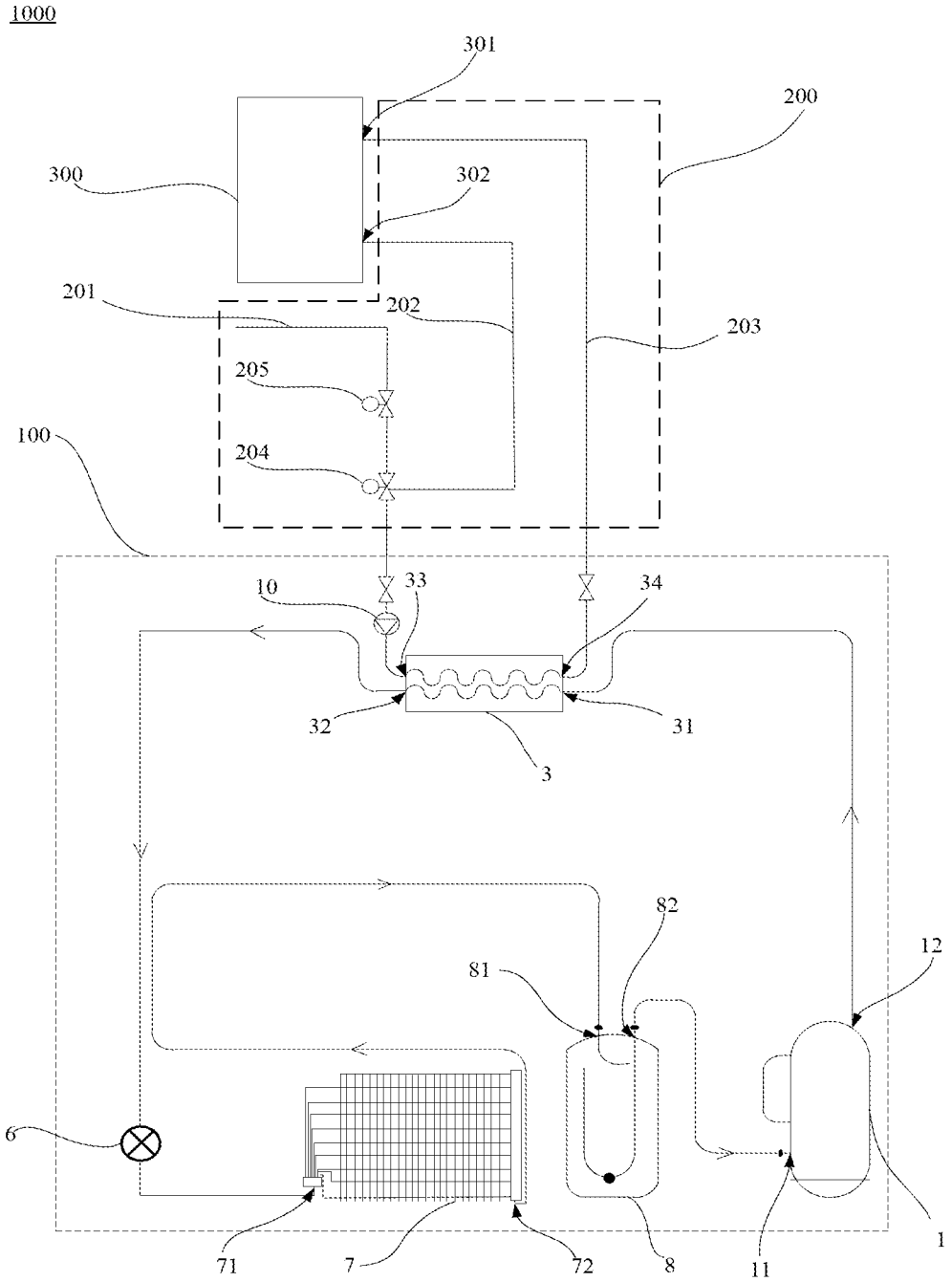
FIG. 3 is a structural diagram of yet another $CO_2$ heat pump system, in accordance with some embodiments.

FIG. 3 is a structural diagram of yet another $CO_2$ heat pump system, in accordance with some embodiments. As shown in FIG. 3, the $CO_2$ heat pump system 1000 further includes a gas-liquid separator 8. The gas-liquid separator 8 includes a gas inlet 81 and a gas outlet 82. The gas-liquid separator 8 is located between the evaporator 7 and the compressor 1, the gas inlet 81 of the gas-liquid separator 8 is connected to the gas outlet 72 of the evaporator 7, and the gas outlet 82 of the gas-liquid separator 8 is connected to the first suction port 11 of the compressor 1.

In some embodiments, in a case where the $CO_2$ heat pump system 1000 is used to heat the water from the external water source, the high-temperature and high-pressure refrigerant is discharged from the first exhaust port 12 of the compressor 1, and enters the first heat exchanger 3 through the refrigerant inlet 31. The high-temperature and high-pressure refrigerant entering the first heat exchanger 3 transfers heat to the water in the first heat exchanger 3. The refrigerant that has undergone heat exchange in the first heat exchanger 3 flows out from the refrigerant outlet 32, flows through the first throttling device 6, and enters the evaporator 7 through the gas inlet 71 for heat absorption and evaporation. Then, the refrigerant flows out from the gas outlet 72 and enters the gas-liquid separator 8 through the gas inlet 81. The gas-liquid separator 8 performs gas-liquid separation on the refrigerant in a gas-liquid two-phase state discharged from the evaporator 7, which prevents the compressor 1 from sucking gas with liquid. Finally, the refrigerant is discharged from the gas outlet 82 and returns to the compressor 1 via the first suction port 11. Thus, the heating cycle is completed.

That providing the gas-liquid separator 8 between the gas outlet 72 of the evaporator 7 and the first suction port 11 of the compressor 1 not only can have a function of performing the gas-liquid separation on the refrigerant in the gas-liquid two-phase state discharged from the evaporator 7 and prevent the compressor 1 from sucking gas with liquid, but also can buffer a pressure of the refrigerant discharged from the evaporator 7, so as to ensure that a suction pressure of the compressor 1 is stable and an operation of the compressor 1 is safe and reliable. In some embodiments, in a case where the $CO_2$ heat pump system is used to defrost the evaporator 7, the refrigerant is discharged from the first exhaust port 12 of the compressor 1, and enters the first heat exchanger 3 through the refrigerant inlet 31 of the first heat exchanger 3. The refrigerant entering the first heat exchanger 3 absorbs the heat of the water in the first heat exchanger 3, so that the temperature of the refrigerant increases. Then, the first throttling device 6 is opened, and the refrigerant discharged from the refrigerant outlet 32 of the first heat exchanger 3 flows through the first throttling device 6, and enters the evaporator 7 through the gas inlet 71 of the evaporator 7 to defrost the evaporator 7. Then, the refrigerant flows out from the gas outlet 72 of the evaporator 7, and enters the gas-liquid separator 8 via the gas inlet 81 of the gas-liquid separator 8, and the gas-liquid separator 8 performs the gas-liquid separation on the refrigerant in the gas-liquid two-phase state discharged from the evaporator 7, which prevents the compressor 1 from sucking gas with liquid. Finally, the refrigerant is discharged from the gas outlet 82 of the gas-liquid separator 8, and returns to the compressor 1 via the first suction port 11 of the compressor 1. Thus, a defrost cycle is completed.

Figure 4:
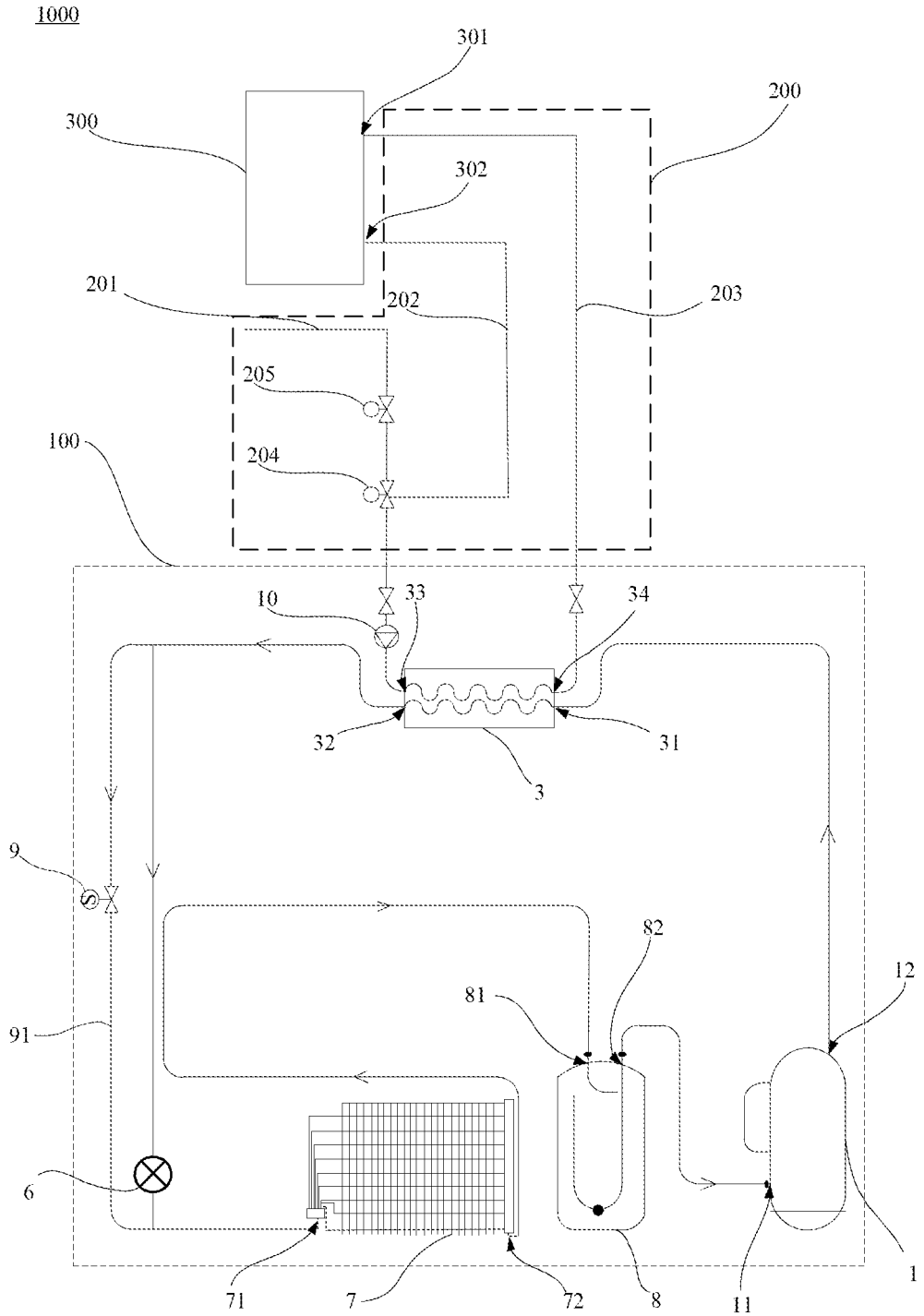
FIG. 4 is a structural diagram of yet another $CO_2$ heat pump system, in accordance with some embodiments.

FIG. 4 is a structural diagram of yet another $CO_2$ heat pump system, in accordance with some embodiments. As shown in FIG. 4, the $CO_2$ heat pump system 1000 further includes a first control valve 9 and a bypass pipeline 91. The first control valve 9 is disposed on the bypass pipeline 91, located between the refrigerant outlet 32 of the first heat exchanger 3 and the gas inlet 71 of the evaporator 7, and disposed in parallel with the first throttling device 6.

In some embodiments, in a case where the $CO_2$ heat pump system 1000 is used to heat the water from the external water source, the high-temperature and high-pressure refrigerant is discharged from the first exhaust port 12 of the compressor 1, and enters the first heat exchanger 3 through the refrigerant inlet 31 of the first heat exchanger 3. The high-temperature and high-pressure refrigerant entering the first heat exchanger 3 transfers heat to the water in the first heat exchanger 3. Then, the first throttling device 6 is opened, and the first control valve 9 is closed. The refrigerant that has undergone heat exchange in the first heat exchanger 3 flows out from the refrigerant outlet 32 of the first heat exchanger 3, passes through the first throttling device 6, and enters the evaporator 7 through the gas inlet 71 of the evaporator 7 for heat absorption and evaporation. Then, the refrigerant flows out from the gas outlet 72 of the evaporator 7, and enters the gas-liquid separator 8 via the gas inlet 81 of the gas-liquid separator 8. Finally, the refrigerant is discharged from the gas outlet 82 of the gas-liquid separator 8, and returns to the compressor 1 via the first suction port 11 of the compressor 1. Thus, the heating cycle is completed.

In some embodiments, in a case where the $CO_2$ heat pump system 1000 is used to defrost the evaporator 7, the refrigerant is discharged from the first exhaust port 12 of the compressor 1, and enters the first heat exchanger 3 through the refrigerant inlet 31 of the first heat exchanger 3. The refrigerant entering the first heat exchanger 3 absorbs the heat of the water in the first heat exchanger 3, so that the temperature of the refrigerant increases. Then, the first throttling device 6 and the first control valve 9 are opened, and the refrigerant is discharged from the refrigerant outlet 32 of the first heat exchanger 3, and enters the evaporator 7 through the first control valve 9 and the first throttling device 6, respectively, to defrost the evaporator 7. Alternately, only the first control valve 9 is opened, and the refrigerant enters the evaporator 7 through the first control valve 9. Then, the refrigerant flows out from the gas outlet 72 of the evaporator 7, and enters the gas-liquid separator 8 via the gas inlet 81 of the gas-liquid separator 8, and the gas-liquid separator 8 performs the gas-liquid separation on the refrigerant. Finally, the refrigerant is discharged from the gas outlet 82 of the gas-liquid separator 8, and returns to the compressor 1 via the first suction port 11 of the compressor 1. Thus, the defrost cycle is completed.

The first control valve 9 is disposed between the refrigerant outlet 32 of the first heat exchanger 3 and the gas inlet 71 of the evaporator 7, so that the refrigerant flowing out from the first heat exchanger 3 can enter the evaporator 7 through the first control valve 9. Compared with the first throttling device 6, a pressure loss when the refrigerant from the first heat exchanger 3 is introduced into the evaporator 7 through the first control valve 9 is less, so that the temperature of the refrigerant entering the evaporator 7 through the first control valve 9 is higher, which in turn makes the defrosting speed of the $CO_2$ heat pump system faster and a defrosting duration shorter.

In some embodiments, a valve bore when the first control valve 9 is fully opened is greater than a valve bore when the first throttling device 6 is fully opened, so that a flow resistance of the refrigerant when the first control valve 9 is fully opened is less than a flow resistance of the refrigerant when the first throttling device 6 is fully opened. When the first control valve 9 is fully opened, most or all of the refrigerant directly enters the evaporator 7 through the first control valve 9, so that the temperature of the refrigerant in the evaporator 7 is relatively high, and the pressure loss is relatively little, which in turn makes the defrosting speed of the $CO_2$ heat pump system relatively fast and the defrosting duration relatively short.

In some embodiments, the first control valve 9 is a valve with a fixed bore, and an opening degree adjustment is not required. In this case, it is only necessary to ensure that the valve bore of the first control valve 9 is greater than the valve bore when the first throttling device 6 is fully opened.

In some embodiments, the first control valve 9 may be a solenoid valve or an electronic expansion valve.

In some embodiments, on the basis of a structure shown in FIG. 2, only the first control valve 9 is added to the $CO_2$ heat pump system 1000 without adding the gas-liquid separator 8.

Figure 5:
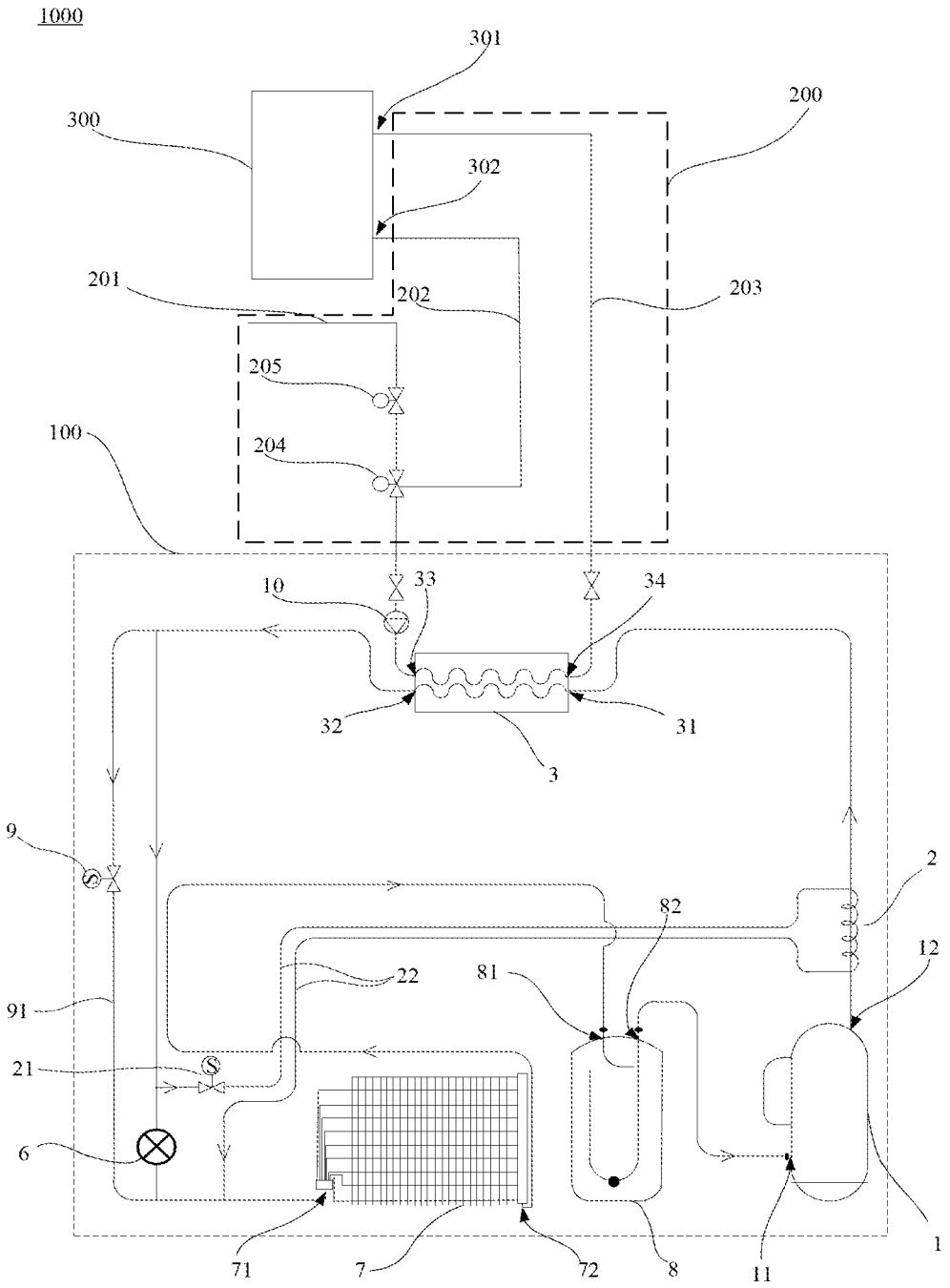
FIG. 5 is a structural diagram of yet another $CO_2$ heat pump system, in accordance with some embodiments.

FIG. 5 is a structural diagram of yet another $CO_2$ heat pump system, in accordance with some embodiments. As shown in FIG. 5, the $CO_2$ heat pump system 1000 further includes a heat absorber 2, a second control valve 21, and a heat absorption branch 22. The heat absorber 2 and the second control valve 21 are disposed on the heat absorption branch 22. The heat absorption branch 22 is located between the refrigerant outlet 32 of the first heat exchanger 3 and the gas inlet 71 of the evaporator 7, and is connected in parallel with the first throttling device 6 and the first control valve 9. The second control valve 21 is configured to control opening or closing of the heat absorption branch 22. The heat absorber 2 is located on a connecting pipe between the first exhaust port 12 of the compressor 1 and the refrigerant inlet 31 of the first heat exchanger 3, and is configured to absorb the heat of the refrigerant at the first exhaust port 12 of the compressor 1.

In some embodiments, in a case where the $CO_2$ heat pump system 1000 is used to heat the water from the external water source, the high-temperature and high-pressure refrigerant is discharged from the first exhaust port 12 of the compressor 1, and enters the first heat exchanger 3 through the refrigerant inlet 31 of the first heat exchanger 3. The high-temperature and high-pressure refrigerant entering the first heat exchanger 3 transfers heat to the water in the first heat exchanger 3. Then, the first throttling device 6 is opened, and the first control valve 9 and the second control valve 21 are closed. The refrigerant that has undergone heat exchange in the first heat exchanger 3 flows out from the refrigerant outlet 32 of the first heat exchanger 3, passes through the first throttling device 6, and enters the evaporator 7 through the gas inlet 71 of the evaporator 7 for heat absorption and evaporation. Then, the refrigerant flows out from the gas outlet 72 of the evaporator 7 and enters the gas-liquid separator 8 via the gas inlet 81 of the gas-liquid separator 8. Finally, the refrigerant is discharged from the gas outlet 82 of the gas-liquid separator 8, and returns to the compressor 1 via the first suction port 11 of the compressor 1. Thus, the heating cycle is completed.

In some embodiments, in a case where the $CO_2$ heat pump system 1000 is used to defrost the evaporator 7, the refrigerant is discharged from the first exhaust port 12 of the compressor 1, and enters the first heat exchanger 3 through the refrigerant inlet 31 of the first heat exchanger 3. The refrigerant entering the first heat exchanger 3 absorbs the heat of the water in the first heat exchanger 3, so that the temperature of the refrigerant increases. A portion of the refrigerant discharged from the first heat exchanger 3 passes through the first control valve 9 and enters the evaporator 7 via the gas inlet 71, a portion of the refrigerant passes through the first throttling device 6 and enters the evaporator 7 via the gas inlet 71, and a portion of the refrigerant enters the heat absorption branch 22 via the second control valve 21. The refrigerant flowing into the heat absorber 2 on the heat absorption branch 22 absorbs the heat of the refrigerant at the first exhaust port 12 of the compressor 1, so that the temperature of the refrigerant in the heat absorption branch 22 increases. Then, the refrigerant flows out from the heat absorption branch 22, and enters the evaporator 7 through the gas inlet 71 of the evaporator 7. Then, the refrigerant flows out from the gas outlet 72 of the evaporator 7, and enters the gas-liquid separator 8 via the gas inlet 81 of the gas-liquid separator 8, and the gas-liquid separator 8 performs the gas-liquid separation on the refrigerant. Finally, the refrigerant is discharged from the gas outlet 82 of the gas-liquid separator 8, and returns to the compressor 1 via the first suction port 11 of the compressor 1. Thus, the defrost cycle is completed.

In some embodiments, the refrigerant discharged from the first heat exchanger 3 all passes through the first control valve 9 and enters the evaporator 7 via the gas inlet 71, or the refrigerant all enters the heat absorption branch 22 via the second control valve 21, passes through the heat absorber 2 on the heat absorption branch 22, and then enters the evaporator 7 through the gas inlet 71.

The second control valve 21, the heat absorber 2, and the heat absorption branch 22 are disposed between the refrigerant outlet 32 of the first heat exchanger 3 and the gas inlet 71 of the evaporator 7, and the heat absorber 2 is located on the connecting pipe between the first exhaust port 12 of the compressor 1 and the refrigerant inlet 31 of the first heat exchanger 3, so that the refrigerant in the heat absorber 2 may absorb the heat of the refrigerant at the first exhaust port 12 of the compressor 1, which further increases the temperature of the refrigerant at the gas inlet 71 of the evaporator 7, thereby further improving the defrosting speed of the $CO_2$ heat pump system and shortening the defrosting duration of the $CO_2$ heat pump system.

In some embodiments, the heat absorber 2 is disposed on a pipe between the refrigerant outlet 32 of the first heat exchanger 3 and the first throttling device 6, and is configured to absorb the heat of the refrigerant discharged from the refrigerant outlet 32 of the first heat exchanger 3, so that it is possible to increase the temperature of the refrigerant at the gas inlet 71 of the evaporator 7, and further improve the defrosting speed of the $CO_2$ heat pump system and shorten the defrosting duration of the $CO_2$ heat pump system.

In some embodiments, the heat absorber 2 may be a heat exchange tube 2 or a structure with the above-mentioned functions, which is not limited in the present disclosure.

In some embodiments, a valve bore when the second control valve 21 is fully opened is less than the valve bore when the first throttling device 6 is fully opened, and in this way, only a small portion of refrigerant passes through the heat absorber 2 to absorb the heat of the refrigerant at the first exhaust port 12 of the compressor 1. As a result, a degree of reduction in the temperature of the refrigerant at the first exhaust port 12 of the compressor 1 is restricted, and the reduced temperature of the refrigerant can be compensated in time when passing through the first heat exchanger 3, which will not affect the temperature of the refrigerant that finally enters the evaporator 7, and ensure a defrosting effect.

In some embodiments, the second control valve 21 is a valve with a fixed bore, and an opening degree adjustment is not required. In this case, it is only necessary to ensure that the valve bore of the second control valve 21 is less than the valve bore when the first throttling device 6 is fully opened.

In some embodiments, the second control valve 21 may be a solenoid valve or an electronic expansion valve.

In some embodiments, the valve bore when the first control valve 9 is fully opened is greater than the valve bore when the first throttling device 6 is fully opened, and the valve bore when the second control valve 21 is fully opened is less than the valve bore when the first throttling device 6 is fully opened. When the first throttling device 6, the first control valve 9, and the second control valve 21 are all fully opened, it is possible to ensure that most of the high-temperature refrigerant passes through the first control valve 9 and directly enters the evaporator 7, only a small portion of the refrigerant passes through the second control valve 21 and enters the heat absorber 2 for heat recovery, and a refrigerant volume in each branch is appropriate, so that the $CO_2$ heat pump system has good defrosting effect.

In some embodiments, the valve bore when the second control valve 21 is fully opened may also be greater than the valve bore when the first throttling device 6 is fully opened.

In some embodiments, on the basis of the structure shown in FIG. 2, only one or two of the gas-liquid separator 8, the first control valves 9, and a group of the heat absorber 2, the second control valve 21 and the heat absorption branch 22 are added to the $CO_2$ heat pump system 1000, instead of adding all three of them.

Figure 6:
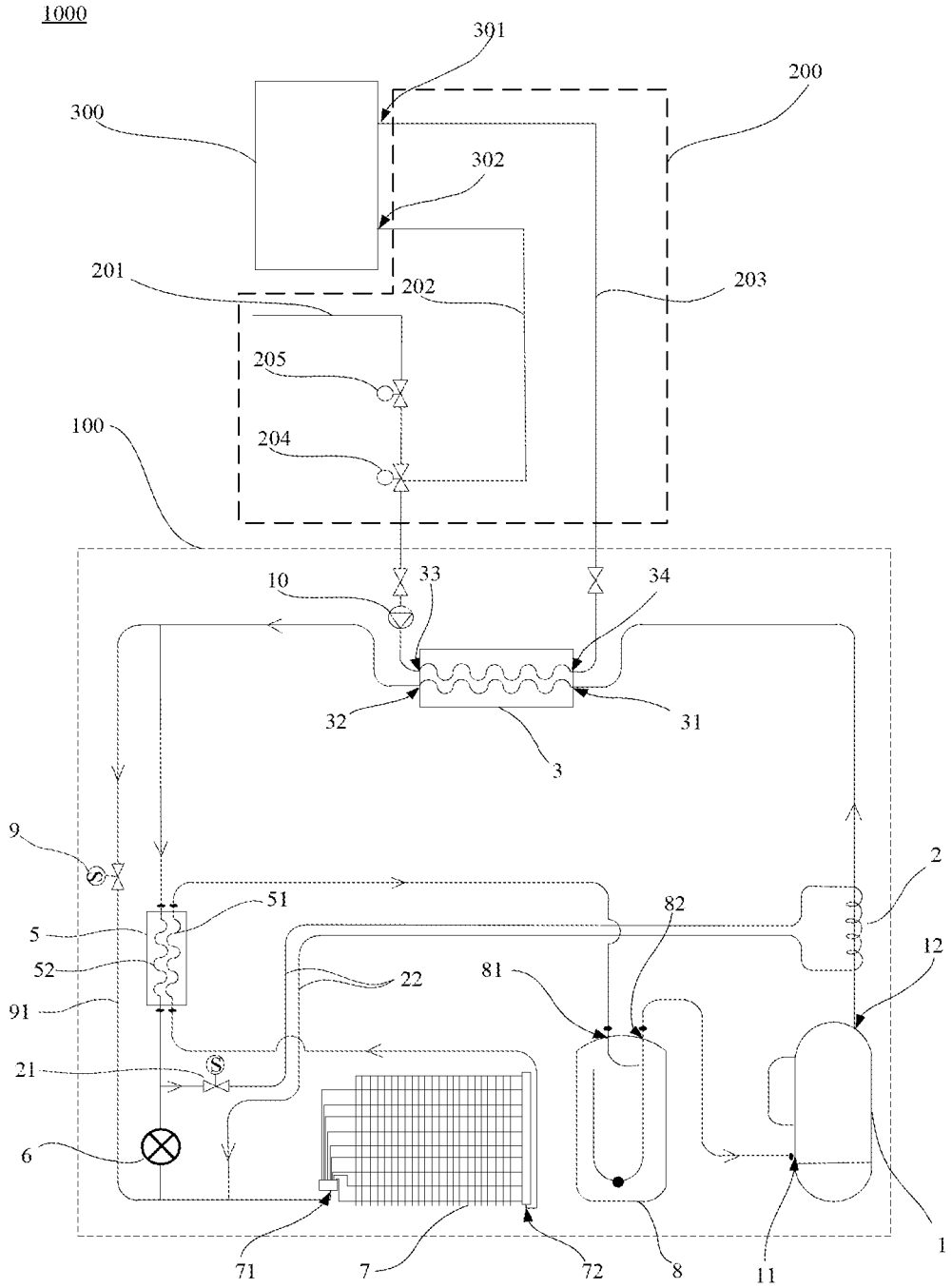
FIG. 6 is a structural diagram of yet another $CO_2$ heat pump system, in accordance with some embodiments.

FIG. 6 is a structural diagram of yet another $CO_2$ heat pump system, in accordance with some embodiments. As shown in FIG. 6, the $CO_2$ heat pump system 1000 further includes a second heat exchanger 5. The second heat exchanger 5 includes a first heat exchange flow path 51 and a second heat exchange flow path 52. The first heat exchange flow path 51 is disposed between the gas outlet 72 of the evaporator 7 and the first suction port 11 of the compressor 1. The second heat exchange flow path 52 is disposed between the refrigerant outlet 32 of the first heat exchanger 3 and the first throttling device 6, and is disposed in parallel with the first control valve 9.

In some embodiments, in a case where the $CO_2$ heat pump system 1000 is used to heat the water from the external water source, the high-temperature and high-pressure refrigerant is discharged from the first exhaust port 12 of the compressor 1, and enters the first heat exchanger 3 through the refrigerant inlet 31 of the first heat exchanger 3. The high-temperature and high-pressure refrigerant entering the first heat exchanger 3 transfers heat to the water in the first heat exchanger 3. Then, the first throttling device 6 is opened, and the first control valve 9 and the second control valve 21 are closed. The refrigerant that has undergone heat exchange in the first heat exchanger 3 flows out from the refrigerant outlet 32 of the first heat exchanger 3, sequentially passes through the second heat exchange flow path 52 and the first throttling device 6, and enters the evaporator 7 through the gas inlet 71 of the evaporator 7 for heat absorption and evaporation. Then, the refrigerant flows out from the gas outlet 72 of the evaporator 7, passes through the first heat exchange flow path 51, and enters the gas-liquid separator 8 through the gas inlet 81 of the gas-liquid separator 8, and the gas-liquid separator 8 performs the gas-liquid separation on the refrigerant. Finally, the refrigerant is discharged from the gas outlet 82 of the gas-liquid separator 8, and returns to the compressor 1 via the first suction port 11 of the compressor 1. Thus, the heating cycle is completed.

The second heat exchanger 5 is added to the $CO_2$ heat pump system 1000, so that the refrigerant, when passing through the first heat exchange flow path 51 of the second heat exchanger 5, can absorb the heat of the refrigerant in the second heat exchange flow path 52 in the second heat exchanger 5, which ensures that the refrigerant flowing out from the first heat exchange flow path 51 of the second heat exchanger 5 has a proper degree of superheat before entering the compressor 1, and prevents the compressor 1 from sucking gas with liquid. As a result, a safe and reliable operation of the compressor 1 is ensured.

In some embodiments, in a case where the $CO_2$ heat pump system 1000 is used to defrost the evaporator 7, the refrigerant is discharged from the first exhaust port 12 of the compressor 1, and enters the first heat exchanger 3 through the refrigerant inlet 31 of the first heat exchanger 3. The refrigerant entering the first heat exchanger 3 absorbs the heat of the water in the first heat exchanger 3, so that the temperature of the refrigerant increases. Then, the first throttling device 6, the first control valve 9, and the second control valve 21 are opened. The refrigerant discharged through the refrigerant outlet 32 of the first heat exchanger 3 flows through the second heat exchange flow path 52 of the second heat exchanger 5 and the first control valve 9. The refrigerant flowing through the first control valve 9 enters the evaporator 7 through the gas inlet 71. A portion of the refrigerant flowing through the second heat exchange flow path 52 flows through the first throttling device 6 and enters the evaporator 7 through the gas inlet 71; and another portion of the refrigerant flowing through the second heat exchange flow path 52 flows into the heat absorption branch 22, passes through the second control valve 21 and the heat absorber 2, and enters the evaporator 7 through the gas inlet 71. The refrigerant discharged after being condensed to release heat in the evaporator 7 passes through the first heat exchange flow path 51 and enters the gas-liquid separator 8 through the gas inlet 81 of the gas-liquid separator 8, and the gas-liquid separator 8 performs the gas-liquid separation on the refrigerant. Finally, the refrigerant is discharged from the gas outlet 82 of the gas-liquid separator 8, and returns to the compressor 1 via the first suction port 11 of the compressor 1. Thus, the defrost cycle is completed.

In some embodiments, a volume of the refrigerant passing through the second heat exchanger 5 may be adjusted by adjusting the valve bore of the first throttling device 6 to ensure the stable operation of the $CO_2$ heat pump system.

In some embodiments, on the basis of the structure shown in FIG. 2, only one, two, or three of the second heat exchanger 5, the gas-liquid separator 8, the first control valve 9, and the group of the heat absorber 2, the second control valve 21 and the heat absorption branch 22 are added to the $CO_2$ heat pump system 1000, instead of adding all four of them.

Figure 7:
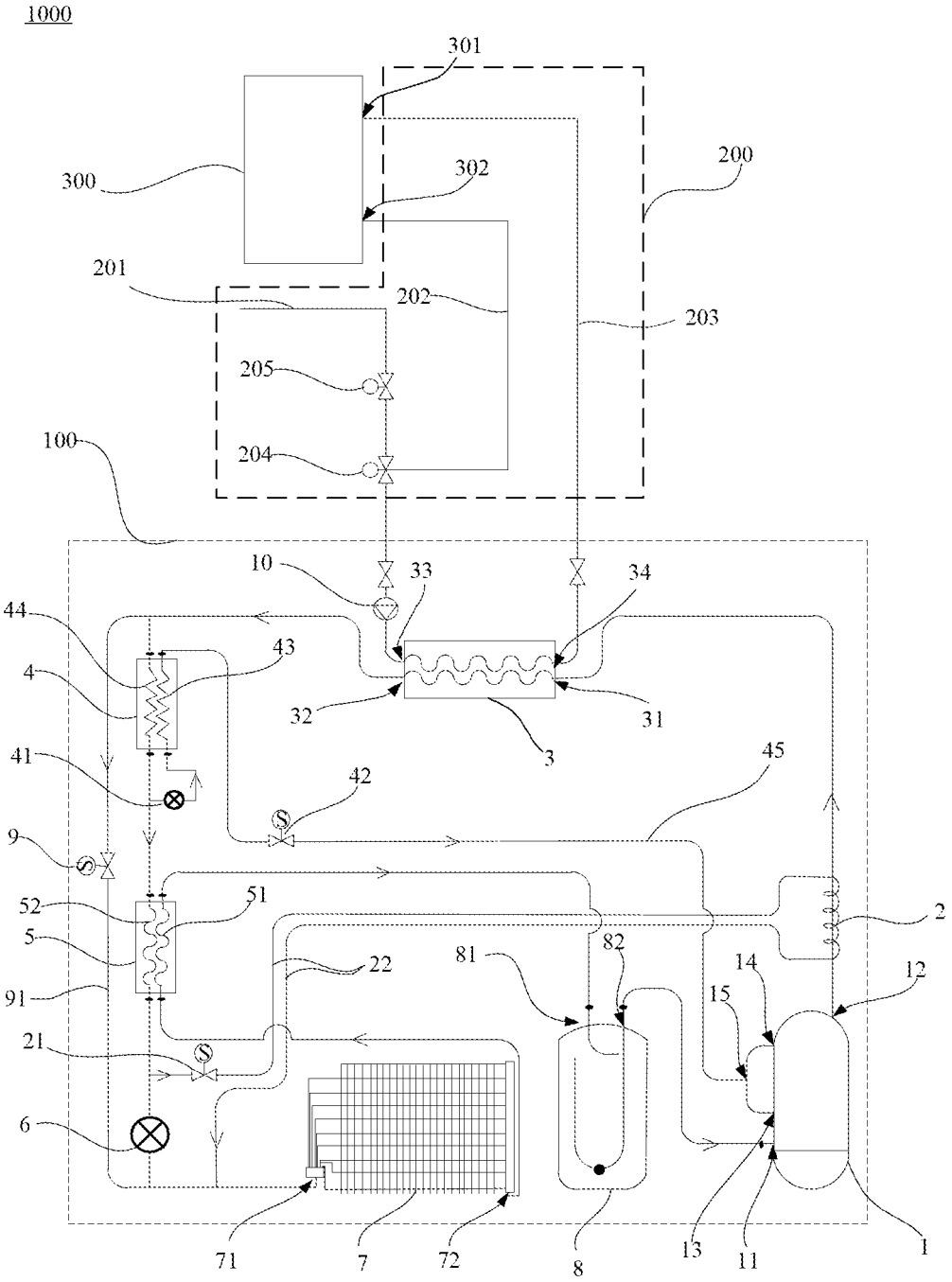
FIG. 7 is a structural diagram of yet another $CO_2$ heat pump system, in accordance with some embodiments.

FIG. 7 is a structural diagram of yet another $CO_2$ heat pump system, in accordance with some embodiments. As shown in FIG. 7, the $CO_2$ heat pump system 1000 further includes an economizer 4, a second throttling device 41, a third control valve 42, and a gas supplementing branch 45. The economizer 4 includes a third heat exchange flow path 43 and a fourth heat exchange flow path 44. The compressor 1 further includes a second exhaust port 13, a second suction port 14, and a gas supplementing port 15. The gas supplementing port 15 of the compressor 1 is disposed on a pipeline where the second exhaust port 13 and the second suction port 14 of the compressor 1 are communicated. The fourth heat exchange flow path 44 is located between the refrigerant outlet 32 of the first heat exchanger 3 and the first throttling device 6; the third heat exchange flow path 43 is located between the first throttling device 6 and the gas supplementing port of the compressor 1; the second throttling device 41 is located between the first throttling device 6 and the third heat exchange flow path 43; and the third control valve 42 is disposed on the gas supplementing branch 45 and located between the third heat exchange flow path 43 and the gas supplementing port 15 of the compressor 1. The second throttling device 41 and the third control valve 42 are configured to control opening or closing of the supplementing air branch 45.

In some embodiments, in a case where the $CO_2$ heat pump system 1000 is used to heat the water from the external water source, the high-temperature and high-pressure refrigerant is discharged from the first exhaust port 12 of the compressor 1, and enters the first heat exchanger 3 through the refrigerant inlet 31 of the first heat exchanger 3. The high-temperature and high-pressure refrigerant entering the first heat exchanger 3 transfers heat to the water in the first heat exchanger 3. Then, the first throttling device 6, the second throttling device 41, and the third control valve 42 are opened, and the first control valve 9 and the second control valve 21 are closed. The refrigerant that has undergone heat exchange in the first heat exchanger 3 flows out from the refrigerant outlet 32 of the first heat exchanger 3 and passes through the fourth heat exchange flow path 44. A portion of the refrigerant flowing out from the fourth heat exchange flow path 44 flows through the second heat exchange flow path 52 and the first throttling device 6, and enters the evaporator 7 through the gas inlet 71 for heat absorption and evaporation; and another portion of the refrigerant flowing out from the fourth heat exchange flow path 44 flows through the second throttling device 41, the third heat exchange flow path 43, and the third control valve 42, and enters the compressor 1 through the gas supplementing port 15 of the compressor 1. Then, the refrigerant entering the evaporator 7 flows out from the gas outlet 72 of the evaporator 7, passes through the first heat exchange flow path 51, and enters the gas-liquid separator 8 through the gas inlet 81 of the gas-liquid separator 8, and the gas-liquid separator 8 performs the gas-liquid separation on the refrigerant. Finally, the refrigerant is discharged from the gas outlet 82 of the gas-liquid separator 8, and returns to the compressor 1 via the first suction port 11 of the compressor 1. Thus, the heating cycle is completed.

The economizer 4 is added to the $CO_2$ heat pump system 1000, so that the refrigerant, after flowing out from the fourth heat exchange flow path 44 of the economizer 4, enters the third heat exchange flow path 43 of the economizer 4 through the second throttling device 41. The refrigerant in the third heat exchange flow path 43 absorbs the heat of the refrigerant in the fourth heat exchange flow path 44, so that the temperature of the refrigerant flowing out from the fourth heat exchange flow path 44 is reduced. As a result, a capability of evaporation of the evaporator 7 is improved. In addition, the refrigerant in the third heat exchange flow path 43 absorbs the heat of the refrigerant in the fourth heat exchange flow path 44, so that the refrigerant flowing out from the third heat exchange flow path 43 becomes in a gas-liquid two-phase state or in a superheated state, then flows through the third control valve 42, and enters the compressor 1 through the gas supplementing port 15 of the compressor 1 for gas supplementation. As a result, a displacement of the compressor 1 is improved, and further, the heating capacity of the $CO_2$ heat pump system 1000 is improved.

In some embodiments, in a case where an ambient temperature is less than or equal to 5° C., and the $CO_2$ heat pump system 1000 heats water from the external water source or heats water in the water tank 300, the economizer 4 operates, and the second throttling device 41 and the third control valve 42 are opened. In a case where the ambient temperature is greater than 5° C., and the $CO_2$ heat pump system 1000 heats water from the external water source or heats water in the water tank 300, the second throttling device 41 and the third control valve 42 are closed.

In some embodiments, in a case where the $CO_2$ heat pump system 1000 is used to defrost the evaporator 7, the refrigerant is discharged from the first exhaust port 12 of the compressor 1, and enters the first heat exchanger 3 through the refrigerant inlet 31 of the first heat exchanger 3. The refrigerant entering the first heat exchanger 3 absorbs the heat of the water in the first heat exchanger 3, so that the temperature of the refrigerant increases. Then, the first throttling device 6, the first control valve 9, and the second control valve 21 are opened, and the second throttling device 41 and the third control valve 42 are closed. The refrigerant discharged through the refrigerant outlet 32 of the first heat exchanger 3 flows through the fourth heat exchange flow path 44 of the economizer 4 and the first control valve 9. The refrigerant flowing through the first control valve 9 enters the evaporator 7 through the gas inlet 71 of the evaporator 7. The refrigerant flowing through the fourth heat exchange flow path 44 enters the second heat exchange flow path 52 after flowing out from the fourth heat exchange flow path 44. A portion of the refrigerant flowing out from the second heat exchange flow path 52 flows through the first throttling device 6 and enters the evaporator 7 through the gas inlet 71; and another portion of the refrigerant flows into the heat absorption branch 22, passes through the second control valve 21 and the heat absorber 2, and enters the evaporator 7 through the gas inlet 71. The refrigerant discharged after being condensed to release heat in the evaporator 7 passes through the first heat exchange flow path 51 and enters the gas-liquid separator 8 through the gas inlet 81 of the gas-liquid separator 8, and the gas-liquid separator 8 performs the gas-liquid separation on the refrigerant. Finally, the refrigerant is discharged from the gas outlet 82 of the gas-liquid separator 8, and returns to the compressor 1 via the first suction port 11 of the compressor 1, and the defrost cycle is completed.

In some embodiments, the second throttling device 41 is disposed on a connecting pipe between the first heat exchanger 3 and the fourth heat exchange flow path 44 of the economizer 4.

In some embodiments, the economizer 4 is disposed on a pipe between the second heat exchanger 5 and the first throttling device 6, and the second throttling device 41 is disposed on a connecting pipe between the second heat exchanger 5 and the first throttling device 6.

In some embodiments, the economizer 4 may also be replaced by a flash-tank 4, which is not limited in the present disclosure.

In some embodiments, the third control valve 42 may be a solenoid valve or an electronic expansion valve.

In some embodiments, on the basis of the structure shown in FIG. 2, only one, two, three, or four of the gas-liquid separator 8, the first control valve 9, the second heat exchanger 5, the group of the heat absorber 2, the second control valve 21 and the heat absorption branch 22, and a group of the economizer 4, the second throttling device 41 and the third control valve 42 are added to the $CO_2$ heat pump system 1000, instead of adding all five of them.

As shown in FIG. 1B, the $CO_2$ heat pump system 1000 further includes a controller 400, a suction pressure sensor 16, a suction temperature sensor 17, an exhaust temperature sensor 18, a refrigerant outlet temperature sensor 35, a gas tube temperature sensor 73, a fluid pipe temperature sensor 74, and an ambient temperature sensor 500. The controller 400 is connected to the suction pressure sensor 16, the suction temperature sensor 17, the exhaust temperature sensor 18, the refrigerant outlet temperature sensor 35, the gas tube temperature sensor 73, the fluid pipe temperature sensor 74, and the ambient temperature sensor 500. The dash-dotted lines in FIG. 1B represent electrical connection lines. The controller 400 includes a timer 401.

The controller 400 includes a processor. The processor may include a central processing unit (CPU), a microprocessor, an application specific integrated circuit (ASIC), or a programmable logic device (such as a field programmable gate array (FPGA)), and may be configured to perform the corresponding operations described with reference to the controller 400 when the processor executes a program stored in a non-transitory computer readable media coupled to the controller. The non-transitory computable readable medium may include a magnetic storage device (e.g., a hard disk, a floppy disk, or a tape), an optical disk (e.g., a compact disk (CD), and a digital versatile disk (DVD)), a smart card, or a flash memory device (e.g., an erasable programmable read-only memory (EPROM), a card, a stick or a key drive).

The suction pressure sensor 16 is located at the first suction port 11 of the compressor 1, and is configured to detect a suction pressure of the compressor 1. The suction temperature sensor 17 is located at the first suction port 11 of the compressor 1, and is configured to detect a temperature at the first suction port of the compressor 1. The exhaust temperature sensor 18 is located at the first exhaust port 12 of the compressor, and is configured to detect a temperature at the first exhaust port 12 of the compressor 1.

The refrigerant outlet temperature sensor 35 is located at the refrigerant outlet 32 of the first heat exchanger 3, and is configured to detect a temperature at the refrigerant outlet of the first heat exchanger 3.

The gas tube temperature sensor 73 is located at a main gas tube of the evaporator 7, and is configured to detect a temperature of the main gas tube; and the main gas tube is connected to the gas outlet 72 of the evaporator 7. The fluid pipe temperature sensor 74 is located at a main fluid pipe of the evaporator 7, and is configured to detect a temperature of the main fluid pipe of the evaporator; and the main fluid pipe is connected to the gas inlet 71 of the evaporator 7.

The ambient temperature sensor 500 is configured to detect an ambient temperature of the $CO_2$ heat pump system 1000.

Figure 8:
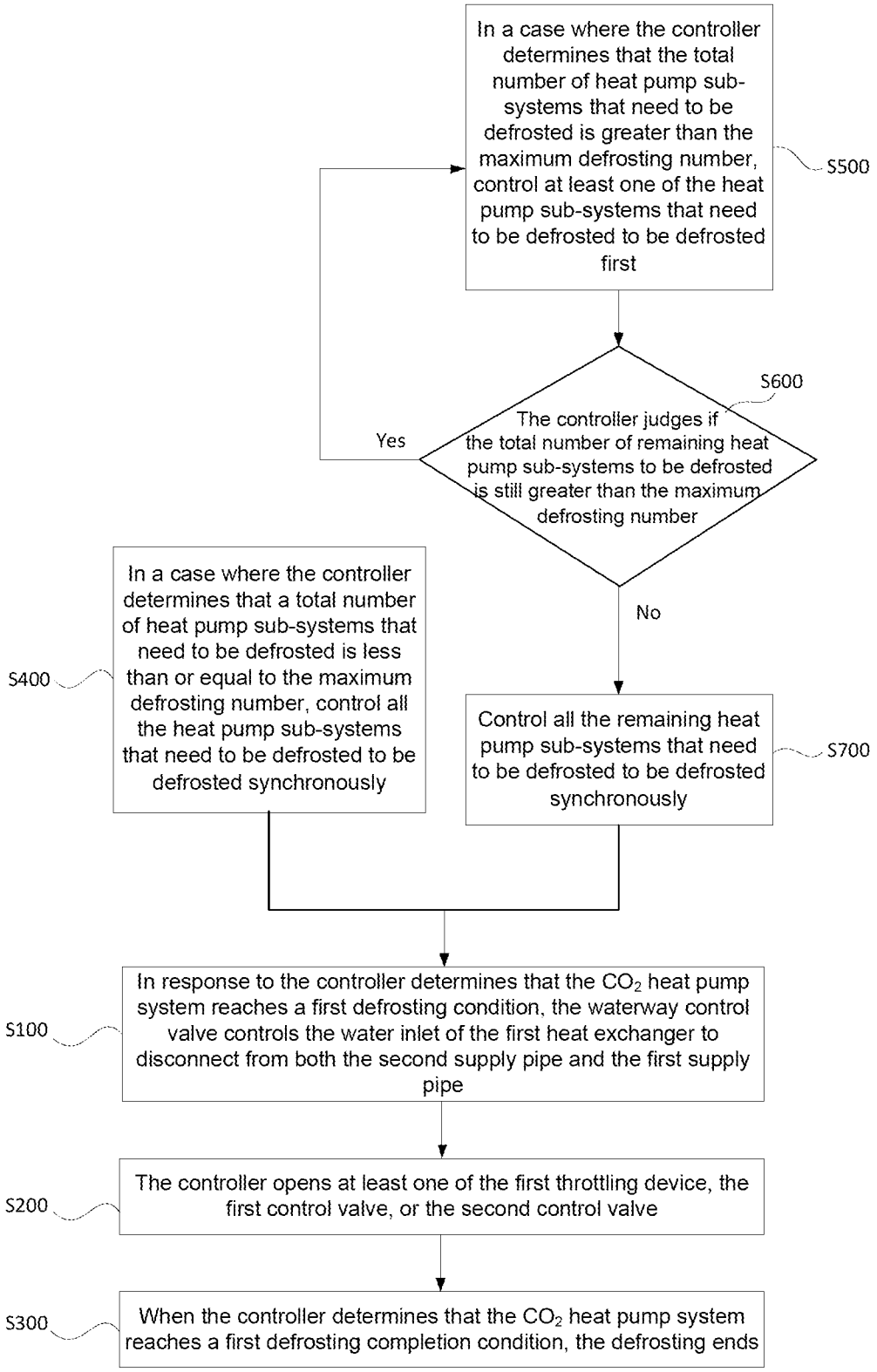
FIG. 8 is a flow diagram of a defrosting control method of a $CO_2$ heat pump system, in accordance with some embodiments.

Some embodiments of the present disclosure further provide a defrosting control method of a $CO_2$ heat pump system. The $CO_2$ heat pump system may be any of the aforementioned $CO_2$ heat pump systems 1000. As shown in FIG. 8, the defrosting control method of the $CO_2$ heat pump system includes steps S100 to S700.

In S100, in response to that the controller 400 determines the $CO_2$ heat pump system 1000 reaches a first defrosting condition, the waterway control valve 204 controls the water inlet 33 of the first heat exchanger 3 to disconnect from both the hot water supply pipe 202 and the cold water supply pipe 201, so that a defrosting of the evaporator 7 is started.

In some embodiments, the first defrosting condition is that the ambient temperature $T_a$ of the $CO_2$ heat pump system is greater than or equal to a first preset ambient temperature, and the temperature $T_e$ of the main fluid pipe of the evaporator is less than or equal to a first preset fluid pipe temperature and is greater than a second preset fluid pipe temperature. The first preset ambient temperature is in a range of, for example, 5° C. to 7° C., inclusive; for example, the first preset ambient temperature is 5° C., 5.5° C., 6° C., 6.5° C., or 7° C. The first preset fluid pipe temperature is in a range of, for example, −1° C. to −3° C., inclusive; for example, the first preset fluid pipe temperature is −1° C., −1.2° C., −1.4° C., −2° C., −2.5° C., or −3° C. The second preset fluid pipe temperature is in a range of, for example, −4° C. to −5° C., inclusive; for example, the second preset fluid pipe temperature is −4° C., −4.2° C., −4.4° C., or −4.6° C.

The controller 400 obtains the ambient temperature $T_a$ of the $CO_2$ heat pump system 1000 detected by the ambient temperature sensor 500 and the temperature $T_e$ of the main fluid pipe of the evaporator 7 detected by the fluid pipe temperature sensor 74, and determines whether the ambient temperature $T_a$ of the $CO_2$ heat pump system 1000 is greater than or equal to the first preset ambient temperature, and whether the temperature $T_e$ of the main fluid pipe of the evaporator 7 is less than or equal to the first preset fluid pipe temperature and is greater than the second preset fluid pipe temperature. In a case where the ambient temperature $T_a$ of the $CO_2$ heat pump system 1000 is greater than or equal to the first preset ambient temperature and the temperature $T_e$ of the main fluid pipe of the evaporator 7 is less than or equal to the first preset fluid pipe temperature and is greater than the second preset fluid pipe temperature, the controller 400 controls the waterway control valve 204 to disconnect the water inlet 33 of the first heat exchanger 3 from both the hot water supply pipe 202 and the cold water supply pipe 201, so that the defrosting of the evaporator 7 is started.

In some embodiments, the first defrosting condition is that the ambient temperature $T_a$ of the $CO_2$ heat pump system 1000 is greater than a second preset ambient temperature and is less than the first preset ambient temperature, and the temperature $T_e$ of the main fluid pipe of the evaporator 7 is less than or equal to a temperature difference between the ambient temperature $T_a$ and a first preset temperature and is greater than a temperature difference between the ambient temperature $T_a$ and a second preset temperature. The second preset ambient temperature is in a range of, for example, −4° C. to −5° C., inclusive; for example, the second preset ambient temperature is −4° C., −4.2° C., −4.5° C., −4.7° C., or −5° C. The first preset temperature is in a range of, for example, 7.5° C. to 8.5° C., inclusive; for example, the first preset temperature is 7.5° C., 7.6° C., 8° C., 8.2° C., 8.4° C., or 8.5° C. The second preset temperature is in a range of, for example, 9° C. to 10° C., inclusive; for example, the second preset temperature is 9° C., 9.2° C., 9.4° C., 9.6° C., or 10° C.

The controller 400 obtains the ambient temperature $T_a$ of the $CO_2$ heat pump system 1000 detected by the ambient temperature sensor 500 and the temperature $T_e$ of the main fluid pipe of the evaporator 7 detected by the fluid pipe temperature sensor 74, and determines whether the ambient temperature $T_a$ of the $CO_2$ heat pump system 1000 is greater than the second preset ambient temperature and is less than the first preset ambient temperature, and whether the temperature $T_e$ of the main fluid pipe of the evaporator 7 is less than or equal to the temperature difference between the ambient temperature $T_a$ and the first preset temperature and is greater than the temperature difference between the ambient temperature $T_a$ and the second preset temperature. In a case where the ambient temperature $T_a$ of the $CO_2$ heat pump system 1000 is greater than the second preset ambient temperature and is less than the first preset ambient temperature, and the temperature $T_e$ of the main fluid pipe of the evaporator 7 is less than or equal to the temperature difference between the ambient temperature $T_a$ and the first preset temperature and is greater than the temperature difference between the ambient temperature $T_a$ and the second preset temperature, the controller 400 controls the waterway control valve 204 to disconnect the water inlet 33 of the first heat exchanger 3 from both the hot water supply pipe 202 and the cold water supply pipe 201, so that the defrosting of the evaporator 7 is started.

In some embodiments, the first defrosting condition is that the ambient temperature $T_a$ of the $CO_2$ heat pump system 1000 is less than or equal to the second preset ambient temperature, and the temperature $T_e$ of the main fluid pipe of the evaporator is less than or equal to a temperature difference between the ambient temperature $T_a$ and a third preset temperature and is greater than a temperature difference between the ambient temperature $T_a$ and a fourth preset temperature. The third preset temperature is in a range of, for example, 6.5° C. to 7.2° C., inclusive; for example, the third preset temperature is 6.5° C., 6.6° C., 7° C., or 7.2° C. The fourth preset temperature is in a range of, for example, 8° C. to 9° C., inclusive; for example, the fourth preset temperature is 8° C., 8.2° C., 8.4° C., 8.6° C., or 9° C.

The controller 400 obtains the ambient temperature $T_a$ of the $CO_2$ heat pump system 1000 detected by the ambient temperature sensor and the temperature $T_e$ of the main fluid pipe of the evaporator 7 detected by the fluid pipe temperature sensor 74, and determines whether the ambient temperature $T_a$ of the $CO_2$ heat pump system 1000 is less than or equal to the second preset ambient temperature, and whether the temperature $T_e$ of the main fluid pipe of the evaporator 7 is less than or equal to the temperature difference between the ambient temperature $T_a$ and the third preset temperature and is greater than the temperature difference between the ambient temperature $T_a$ and the fourth preset temperature. In a case where the ambient temperature $T_a$ of the $CO_2$ heat pump system 1000 is less than or equal to the second preset ambient temperature, and the temperature $T_e$ of the main fluid pipe of the evaporator 7 is less than or equal to the temperature difference between the ambient temperature $T_a$ and the third preset temperature and is greater than the temperature difference between the ambient temperature $T_a$ and the fourth preset temperature, the controller 400 controls the waterway control valve 204 to disconnect the water inlet 33 of the first heat exchanger 3 from both the hot water supply pipe 202 and the cold water supply pipe 201, so that the defrosting of the evaporator 7 is started.

In a case where the $CO_2$ heat pump system 1000 heats the water from the external water source or the water in the water tank 300, the refrigerant in the first heat exchanger 3 will transfer the heat to the water in the first heat exchanger 3, so that the temperature of the refrigerant at the gas inlet 71 of the evaporator 7 is relatively low, which results in a relatively low temperature of the main fluid pipe of the evaporator 7 connected to the gas inlet 71. The lower the temperature of the refrigerant entering the evaporator 7, the more heat the refrigerant absorbs in the evaporator 7, resulting in frosting on the surface of the evaporator. When the temperature of the main fluid pipe of the evaporator 7 is low enough to meet the first defrosting condition, the $CO_2$ heat pump system 1000 starts the defrosting.

In some embodiments, the first defrosting condition is that the suction pressure $P_s$ of the compressor 1 is less than or equal to a first preset pressure and is greater than a second preset pressure, and a duration $t_s$ during which the suction pressure of the compressor 1 is less than or equal to the first preset pressure and is greater than the second preset pressure reaches a first preset duration. The first preset pressure is in a range of, for example, 2.1 MP to 2.3 MP, inclusive; for example, the first preset pressure is 2.1 MP, 2.15 MP, 2.2 MP, 2.25 MP, or 2.3 MP. The second preset pressure is in a range of, for example, 1.8 MP to 1.9 MP, inclusive; for example, the second preset pressure is 1.8 MP, 1.82 MP, 1.84 MP, 1.86 MP, or 1.9 MP. The first preset duration is in a range of, for example, 1 minute to 2 minutes, inclusive; for example, the first preset duration is 1 minute, 1.2 minutes, 1.5 minutes, 1.8 minutes, or 2 minutes.

The controller 400 obtains the suction pressure $P_s$ of the compressor 1 detected by the suction pressure sensor 16, and determines whether the suction pressure $P_s$ of the compressor 1 is less than or equal to the first preset pressure and is greater than the second preset pressure. In a case where the suction pressure $P_s$ of the compressor 1 is less than or equal to the first preset pressure and is greater than the second preset pressure, the controller 400 obtains the duration, recorded by the timer 401, during which the suction pressure of the compressor 1 is less than or equal to the first preset pressure and is greater than the second preset pressure. In a case where the duration counted by the timer 401 is greater than or equal to the first preset duration, the controller 400 controls the waterway control valve 204 to disconnect the water inlet 33 of the first heat exchanger 3 from both the hot water supply pipe 202 and the cold water supply pipe 201, so that the defrosting of the evaporator 7 is started.

For example, in a case where the first preset ambient temperature is 6° C., the second preset ambient temperature is −5° C., the first preset fluid pipe temperature is −2° C., the second preset fluid pipe temperature is −4° C., the first preset temperature is 8° C., the second preset temperature is 10° C., the third preset temperature is 7° C., the fourth preset temperature is 9° C., the first preset pressure is 2.2 MP, the second preset pressure is 1.9 MP, and the first preset duration is 1 minute, the first defrosting condition includes one of the following conditions A1, B1, C1, and D1.

A1. The ambient temperature $T_a$ of the $CO_2$ heat pump system is greater than or equal to 6° C. (i.e., $T_a \geq 6°$ C.), and the temperature $T_e$ of the main fluid pipe of the evaporator is less than or equal to −2° C. and is greater than −4° C. (i.e., $-4° \text{ C.} < T_e \leq -2°$ C.);

B1. The ambient temperature $T_a$ of the $CO_2$ heat pump system is less than 6° C. and is greater than −5° C. (i.e., $-5° \text{ C.} < T_a < 6°$ C.), and the temperature $T_e$ of the main fluid pipe of the evaporator is less than or equal to a difference between the ambient temperature $T_a$ and 8° C. and is greater than a difference between the ambient temperature $T_a$ and 10° C. (i.e., $T_a - 10° \text{ C.} < T_e - 8°$ C.);

C1. The ambient temperature $T_a$ of the $CO_2$ heat pump system is less than or equal to −5° C. (i.e., $T_a \leq -5°$ C.), and the temperature $T_e$ of the main fluid pipe of the evaporator is less than or equal to a difference between the ambient temperature $T_a$ and 7° C. and is greater than a difference between the ambient temperature $T_a$ and 9° C. (i.e., $T_a - 9° \text{ C.} < T_e < T_a - 7°$ C.); and D1. The suction pressure $P_s$ of the compressor 1 of the $CO_2$ heat pump system is less than or equal to 2.2 MP and is greater than 1.9 MP (i.e., $1.9 \text{ MP} < P_s \leq 2.2$ MP), and the duration $t_s$ of $1.9 \text{ MP} < P_s \leq 2.2$ MP reaches 1 minute (i.e., $t_s \geq 1$ min).

The first defrosting condition indicates that a frost layer on the evaporator 7 is relatively thin. For example, the frost layer is thinner than 2 mm. For example, a thickness of the frost layer is 2.0 mm, 1.8 mm, 1.5 mm, 1.2 mm, 1.0 mm, 0.8 mm, 0.5 mm, or 0.2 mm.

The refrigerant discharged from the first exhaust port of the compressor 1 enters the first heat exchanger 3 from the refrigerant inlet 31 of the first heat exchanger 3.

In S200, the controller 400 opens at least one of the first throttling device 6, the first control valve 9, or the second control valve 21.

The controller 400 controls at least one of the first throttling device 6, the first control valve 9, or the second control valve 21 to open. The refrigerant discharged from the refrigerant outlet 32 of the first heat exchanger 3 flows through at least one of the first throttling device 6, the first control valve 9, or the second control valve 21, and enters the evaporator 7 from the gas inlet 71 of the evaporator 7, and a defrosting is performed on the evaporator 7.

It will be noted that in a case where the $CO_2$ heat pump system 1000 does not include the first control valve 9 or the second control valve 21, the controller 400 may not need to open the first control valve 9 or the second control valve 21.

In a case where the controller 400 opens at least the first throttling device 6 and the first control valve 9, the above S200 includes steps S210 and S220.

In S210, the controller 400 opens the first throttling device 6 with a preset opening degree, and opens the first control valve 9 with a maximum opening degree.

In some embodiments, the preset opening degree of the first throttling device 6 is 2% of a maximum opening degree of the first throttling device 6. The maximum opening degree of the first throttling device 6 is in a range of 400 pls (pls refers to pulse) to 550 pls, inclusive; for example, the maximum opening degree of the first throttling device 6 is 400 pls, 450 pls, 500 pls, or 550 pls. The preset opening degree of the first throttling device 6 is in a range of 8 pls to 11 pls, inclusive; for example, the preset opening degree of the first throttling device 6 is 8 pls, 9 pls, 10 pls, or 11 pls. In some embodiments, a stepping motor is controlled to drive the first throttling device 6 to change the opening degree thereof from 0 to the maximum opening degree, and during this process, an encoder is used to convert the opening degree of the first throttling device 6 into a pulse signal, so that the number of pulse signals corresponding to the maximum opening degree is obtained. The opening degree of the first throttling device 6 corresponding to the number of pulse signals may be obtained by counting the pulse signals.

In S220, the controller 400 adjusts the opening degree of the first throttling device 6 to a target opening degree according to a suction superheat degree of the compressor 1. In some embodiments, the target opening degree is an opening degree of the first throttling device 6 when the suction superheat degree of the compressor 1 is equal to a preset suction superheat degree.

The suction superheat degree $T_{so}$ is a difference obtained by subtracting a refrigerant saturation temperature corresponding to the suction pressure from a suction temperature of the compressor. The controller 400 calculates the suction superheat degree $T_{so}$ based on the suction temperature detected by the suction temperature sensor 17 and the suction pressure detected by the suction pressure sensor 16.

In some embodiments, the preset suction superheat degree is in a range of, for example, 0° C. to 2° C., inclusive; for example, the preset suction superheat degree is 0° C., 0.5° C., 1° C., 1.5° C., or 2° C.

That the controller 400 adjusts the opening degree of the first throttling device 6 to the target opening degree according to the suction superheat degree of the compressor 1 in S220 includes steps S221 to S223.

In S221, when determining that the suction superheat degree of the compressor 1 is greater than the preset suction superheat degree, the controller 400 reduces the opening degree of the first throttling device 6 to the target opening degree. That the suction superheat degree of the compressor 1 is greater than the preset suction superheat degree indicates that in this case, most of the refrigerant in the $CO_2$ heat pump system 1000 passes through the first throttling device 6, and only a small portion of the refrigerant passes through the first control valve 9. The opening degree of the first throttling device 6 is reduced to the target opening degree, so that the volume of the refrigerant passing through the first throttling device 6 is reduced, the refrigerant saturation temperature corresponding to the suction pressure of the compressor 1 increases, and the suction superheat degree of the compressor 1 is lowered to be equal to the preset suction superheat degree. As a result, the volume of the refrigerant passing through the first control valve 9 increases, and in this case, the defrosting speed of the $CO_2$ heat pump system is relatively fast.

A method for reducing the opening degree of the first throttling device 6 to the target opening degree includes: the controller 400 controls the first throttling device 6 to decrease to the target opening degree at one time on the basis of the current opening degree; or, the control device 400 controls the first throttling device 6 to decrease a predetermined ratio of the preset opening degree multiple times on the basis of the current opening degree, until the opening degree of the first throttling device 6 is reduced to the target opening degree. The predetermined ratio is, for example, 2%, 10%, 20%, 50%, 80%, 100%, 120%, 150%, 200%, or 220%.

In S222, when determining that the suction superheat degree of the compressor 1 is less than the preset suction superheat, the controller 400 increases the opening degree of the first throttling device 6 to the target opening degree.

The suction superheat degree of the compressor 1 is less than the preset suction superheat degree, indicating that most of the refrigerant in the $CO_2$ heat pump system 1000 passes through the first control valve 9, and only a small portion of the refrigerant passes through the first throttling device 6. In this case, sucking gas with liquid is prone to happen in the $CO_2$ heat pump system 1000. By increasing the opening degree of the first throttling device 6 to the target opening degree, the suction superheat degree of the compressor may increase, thereby avoiding a phenomenon of sucking gas with liquid.

The method for increasing the opening degree of the first throttling device 6 to the target opening degree includes: the controller 400 controls the first throttling device 6 to increase to the target opening degree at one time on the basis of the current opening degree; or, the controller 400 controls the first throttling device 6 to increase the predetermined ratio of the preset opening degree multiple times on the basis of the current opening degree, until the opening degree of the first throttling device 6 increases to the target opening degree. The predetermined ratio is, for example, 2%, 10%, 20%, 50%, 80%, 100%, 120%, 150%, 200%, or 220%.

In S223, when determining that a duration during which the first throttling device maintains the target opening degree reaches a control period, the controller 400 returns to perform S221 and S222.

In some embodiments, the control period is in a range of, for example, 10 seconds to 90 seconds, inclusive; for example, the control period is 10 seconds, 20 seconds, 30 seconds, 40 seconds, 50 seconds, 60 seconds, 70 seconds, 80 seconds, or 90 seconds.

After the opening degree of the first throttling device 6 is adjusted to the target opening degree, the controller 400 obtains the duration during which the first throttling device 6 maintains the target opening degree recorded by the timer 401, and in response to a case where the duration recorded by the timer 401 is greater than or equal to the control period, the controller 400 returns to perform S221 and S222.

In S300, when the controller 400 determines that the $CO_2$ heat pump system 1000 reaches a first defrosting completion condition, the defrosting ends.

In some embodiments, the first defrosting completion condition is that a temperature $T_g$ of the main gas tube of the evaporator 7 is greater than or equal to a first preset gas tube temperature. The first preset gas tube temperature is in a range of, for example, 5° C. to 6° C., inclusive; for example, the first preset gas tube temperature is 5° C., 5.2° C., 5.5° C., 5.8° C., or 6° C.

The controller 400 obtains the temperature $T_g$ at the main gas tube of the evaporator 7 detected by the gas tube temperature sensor 73, and determines whether the temperature $T_g$ at the main gas tube of the evaporator 7 is greater than or equal to the first preset gas tube temperature. In a case where the temperature $T_g$ at the main gas tube of the evaporator 7 is greater than or equal to the first preset gas tube temperature, the controller 400 controls the $CO_2$ heat pump system 1000 to make the defrosting to end.

In a case where the $CO_2$ heat pump system 1000 defrosts the evaporator 7, the evaporator 7 absorbs the heat of the refrigerant, so that the evaporator 7 is defrosted. In a process of defrosting the evaporator 7, the frost on the surface of the evaporator 7 becomes thinner and thinner, and the heat that the evaporator 7 needs to absorb from the refrigerant becomes less and less, the temperature of the refrigerant flowing out from the gas outlet 72 of the evaporator 7 becomes higher and higher, and the temperature of the main gas tube of the evaporator 7 connected to the gas outlet 72 also becomes higher and higher. When the temperature of the main gas tube of the evaporator 7 meets the first defrosting completion condition, the $CO_2$ heat pump system 1000 makes the defrosting to end.

In some embodiments, the first defrosting completion condition is that the defrosting duration of the $CO_2$ heat pump system 1000 is greater than or equal to a second preset duration. The second preset duration is in a range of, for example, 8.5 minutes to 9.2 minutes, inclusive; for example, the second preset duration is 8.5 minutes, 8.6 minutes, 8.7 minutes, 9 minutes, or 9.2 minutes.

The controller 400 obtains the defrosting duration of the $CO_2$ heat pump system 1000 recorded by the timer 401, and in a case where the defrosting duration of the $CO_2$ heat pump system 1000 is greater than or equal to the second preset duration, the controller 400 controls the $CO_2$ heat pump system 1000 to make the defrosting to end.

For example, in a case where the first preset main gas tube temperature is 5° C., and the second preset duration is 9 minutes, the first defrosting completion condition is that the temperature $T_g$ of the main gas tube of the evaporator 7 is greater than or equal to 5° C.; or the defrosting duration of the $CO_2$ heat pump system 1000 is greater than or equal to 9 minutes.

In some embodiments, as shown in FIG. 1A, when the $CO_2$ heat pump system 1000 includes a plurality of heat pump sub-systems, the defrosting control method of the $CO_2$ heat pump system 1000 further includes steps S400 and S500.

In S400, when determining that the total number of heat pump sub-systems that need to be defrosted is less than or equal to a maximum defrosting number, the controller 400 controls all the heat pump sub-systems that need to be defrosted to be defrosted synchronously.

In some embodiments, the maximum defrosting number N is calculated by a formula: N=5 L×M/Q. In the formula, Q is a total capacity of the $CO_2$ heat pump system in unit of horse power; M is the total number of heat pump sub-systems; and L is a volume of the water tank 300 in unit of $m^3$.

In some embodiments, in a case where the total number of heat pump sub-systems that need to be defrosted is less than or equal to the maximum defrosting number, it indicates that in this case, an operation of defrosting all the heat pump sub-systems that need to be defrosted will not lead to a reduction in the temperature of the water in the water tank 300, and then the controller 400 controls all the heat pump sub-systems that need to be defrosted to be defrosted synchronously.

In S500, when determining that the total number of heat pump sub-systems to be defrosted is greater than the maximum defrosting number, the controller 400 controls at least one of the heat pump sub-systems to be defrosted to be defrosted first.

In S600, after the defrosting of the at least one heat pump sub-system is completed, the controller 400 judges whether the total number of remaining heat pump sub-systems to be defrosted is still greater than the maximum defrosting number. When determining that the total number of remaining heat pump sub-systems to be defrosted is still greater than the maximum defrosting number, S500 is repeated and the controller 400 controls at least one of the remaining heat pump sub-systems that need to be defrosted to be defrosted. This procedure is repeated until the controller 400 determines that the total number of the remaining heat pump sub-systems that need to be defrosted is less than or equal to the maximum defrosting number, and the S700 is performed.

In S700, all the remaining heat pump sub-systems that need to be defrosted are controlled to be defrosted synchronously.

In some embodiments, when the number of heat pump sub-systems that need to be defrosted is greater than the maximum defrosting number, that is, in this case, if all the heat pump sub-systems that need to be defrosted are defrosted simultaneously, the temperature of the water in the water tank 300 will decrease, which will affect the defrosting speed. Therefore, the controller 400 controls at least one of the heat pump sub-systems that need to be defrosted to be defrosted first, and after the defrosting of the at least one heat pump sub-system is completed, the controller 400 determines again whether the number of the remaining heat pump sub-systems that need to be defrosted is greater than the maximum defrosting number.

When determining that the number of remaining heat pump sub-systems that need to be defrosted is still greater than the maximum defrosting number, the controller 400 controls at least one of the remaining heat pump sub-systems that need to be defrosted to be defrosted. This procedure is repeated until the controller 400 determines that the total number of remaining heat pump sub-systems that need to be defrosted is less than or equal to the maximum defrosting number, and the controller 400 controls all the remaining heat pump sub-systems that need to be defrosted to be defrosted synchronously.

In some embodiments, the at least one heat pump sub-system may be one or more, as long as the number of heat pump sub-systems undergoing defrosting is less than or equal to the maximum defrosting number.

Figure 9:
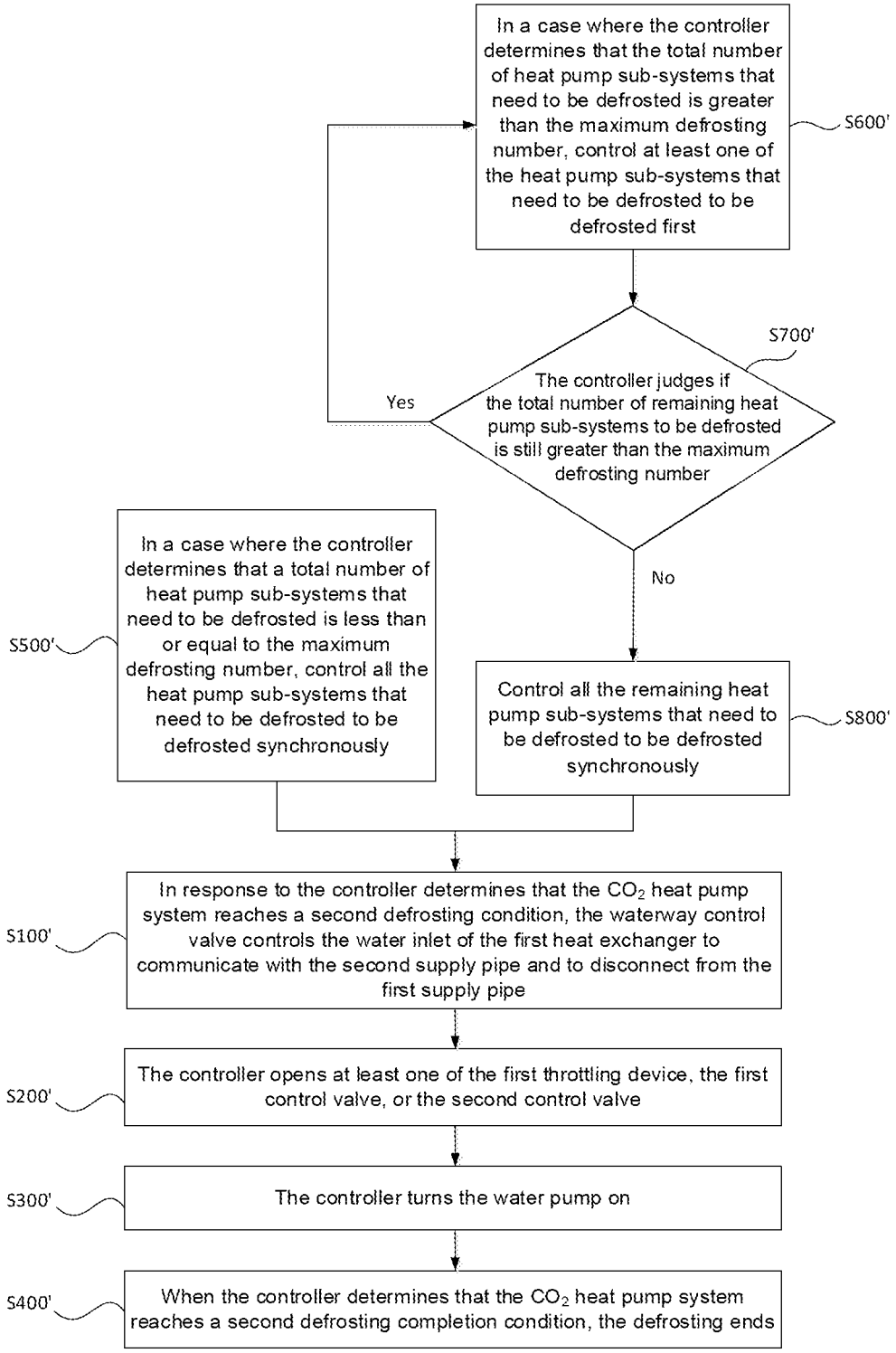
FIG. 9 is a flow diagram of another defrosting control method of a $CO_2$ heat pump system, in accordance with some embodiments.

In some embodiments, as shown in FIG. 9, the defrosting control method of the $CO_2$ heat pump system 1000 further includes steps S100' to S800'.

In S100', in response to that the controller 400 determines the $CO_2$ heat pump system 1000 reaches a second defrosting condition, the waterway control valve 204 controls the water inlet 33 of the first heat exchanger 3 to communicate with the hot water supply pipe 202 and to disconnect from the cold water supply pipe 201, so that a defrosting of the evaporator 7 is started.

In some embodiments, the second defrosting condition is that the ambient temperature $T_a$ of the $CO_2$ heat pump system 1000 is greater than or equal to the first preset ambient temperature and the temperature $T_e$ of the main fluid pipe of the evaporator is less than or equal to the second preset fluid pipe temperature.

The controller 400 obtains the ambient temperature $T_a$ of the $CO_2$ heat pump system 1000 detected by the ambient temperature sensor 500 and the temperature $T_e$ of the main fluid pipe of the evaporator 7 detected by the fluid pipe temperature sensor 74, and determines whether the ambient temperature $T_a$ of the $CO_2$ heat pump system 1000 is greater than or equal to the first preset ambient temperature, and whether the temperature $T_e$ of the main fluid pipe of the evaporator 7 is less than or equal to the second preset fluid pipe temperature. In a case where the ambient temperature $T_a$ of the $CO_2$ heat pump system 1000 is greater than or equal to the first preset ambient temperature and the temperature $T_e$ of the main fluid pipe of the evaporator 7 is less than or equal to the second preset fluid pipe temperature, the controller 400 controls the waterway control valve 204 to communicate the water inlet 33 of the first heat exchanger 3 with the hot water supply pipe 202 and disconnect the water inlet 33 of the first heat exchanger 3 from the cold water supply pipe 201, so that the defrosting of the evaporator 7 is started.

In some embodiments, the second defrosting condition is that the ambient temperature $T_a$ of the $CO_2$ heat pump system 1000 is greater than the second preset ambient temperature and is less than the first preset ambient temperature, and the temperature $T_e$ of the main fluid pipe of the evaporator 7 is less than or equal to a temperature difference between the ambient temperature $T_a$ and the second preset temperature.

The controller 400 obtains the ambient temperature $T_a$ of the $CO_2$ heat pump system 1000 detected by the ambient temperature sensor 500 and the temperature $T_e$ of the main fluid pipe of the evaporator 7 detected by the fluid pipe temperature sensor 74, and determines whether the ambient temperature $T_a$ of the $CO_2$ heat pump system 1000 is greater than the second preset ambient temperature and is less than the first preset ambient temperature, and whether the temperature $T_e$ of the main fluid pipe of the evaporator 7 is less than or equal to the temperature difference between the ambient temperature $T_a$ and the second preset temperature. In a case where the ambient temperature $T_a$ of the $CO_2$ heat pump system 1000 is greater than the second preset ambient temperature and is less than the first preset ambient temperature, and the temperature $T_e$ of the main fluid pipe of the evaporator 7 is less than or equal to the temperature difference between the ambient temperature $T_a$ and the second preset temperature, the controller 400 controls the waterway control valve 204 to communicate the water inlet 33 of the first heat exchanger 3 with the hot water supply pipe 202 and disconnect the water inlet 33 of the first heat exchanger 3 from the cold water supply pipe 201, so that the defrosting of the evaporator 7 is started.

In some embodiments, the second defrosting condition is that the ambient temperature $T_a$ of the $CO_2$ heat pump system is less than or equal to the second preset ambient temperature, and the temperature $T_e$ of the main fluid pipe of the evaporator is less than or equal to a temperature difference between the ambient temperature $T_a$ and the fourth preset temperature.

The controller 400 obtains the ambient temperature $T_a$ of the $CO_2$ heat pump system 1000 detected by the ambient temperature sensor 500 and the temperature $T_e$ of the main fluid pipe of the evaporator 7 detected by the fluid pipe temperature sensor 74, and determines whether the ambient temperature $T_a$ of the $CO_2$ heat pump system 1000 is less than or equal to the second preset ambient temperature, and whether the temperature $T_e$ of the main fluid pipe of the evaporator 7 is less than or equal to the temperature difference between the ambient temperature $T_a$ and the fourth preset temperature. In a case where the ambient temperature $T_a$ of the $CO_2$ heat pump system 1000 is less than or equal to the second preset ambient temperature, and the temperature $T_e$ of the main fluid pipe of the evaporator 7 is less than or equal to the temperature difference between the ambient temperature $T_a$ and the fourth preset temperature, the controller 400 controls the waterway control valve 204 to communicate the water inlet 33 of the first heat exchanger 3 with the hot water supply pipe 202 and disconnect the water inlet 33 of the first heat exchanger 3 from the cold water supply pipe 201, so that the defrosting of the evaporator 7 is started.

In some embodiments, the second defrosting condition is that the suction pressure $P_s$ of the compressor 1 is less than or equal to the second preset pressure, and the duration $t_s$ during which the suction pressure of the compressor 1 is less than or equal to the second preset pressure reaches the first preset duration.

The controller 400 obtains the suction pressure $P_s$ of the compressor 1 detected by the suction pressure sensor 16, and determines whether the suction pressure $P_s$ of the compressor 1 is less than or equal to the second preset pressure. In a case where the suction pressure $P_s$ of the compressor 1 is less than or equal to the second preset pressure, the controller 400 obtains the duration $t_s$, recorded by the timer 401, during which the suction pressure of the compressor 1 is less than or equal to the second preset pressure. In a case where the duration $t_s$ counted by the timer 401 is greater than or equal to the first preset duration, the controller 400 controls the waterway control valve 204 to communicate the water inlet 33 of the first heat exchanger 3 with the hot water supply pipe 202 and disconnect the water inlet 33 of the first heat exchanger 3 from the cold water supply pipe 201, so that the defrosting of the evaporator 7 is started.

For example, in a case where the first preset ambient temperature is 6° C., the second preset ambient temperature is −5° C., the second preset fluid pipe temperature is −4° C., the second preset temperature is 10° C., the fourth preset temperature 9° C., the second preset pressure is 1.9 MP, and the first preset duration is 1 minute, the second defrosting condition includes one of the following conditions A2, B2, C2, and D2.

A2. The ambient temperature $T_a$ of the $CO_2$ heat pump system is greater than or equal to 6° C. (i.e., $T_a \geq 6°$ C.), and the temperature $T_e$ of the main fluid pipe of the evaporator is less than or equal to −4° C. (i.e., $T_e \leq -4°$ C.);

B2. The ambient temperature $T_a$ of the $CO_2$ heat pump system is less than 6° C. and is greater than −5° C. (i.e., $-5° C. < T_a < 6°$ C.), and the temperature $T_e$ of the main fluid pipe of the evaporator is less than or equal to a difference between the ambient temperature $T_a$ and 10° C. (i.e., $T_e \leq T_a - 10°$ C.);

C2. The ambient temperature $T_a$ of the $CO_2$ heat pump system is less than or equal to −5° C. (i.e., $T_a \leq -5°$ C.), and the temperature $T_e$ of the main fluid pipe of the evaporator is less than or equal to a difference between the ambient temperature $T_a$ and 9° C. (i.e., $T_e \leq T_a - 9°$ C.); and D2. The suction pressure $P_s$ of the compressor 1 of the $CO_2$ heat pump system is less than or equal to 1.9 MP (i.e., $P_s \leq 1.9$ MP), and the duration $t_s$ of $P_s \leq 1.9$ MP reaches 1 minute (i.e., $t_s \geq 1$ min).

The second defrosting condition indicates that the frost layer on the evaporator 7 is relatively thick. For example, the frost layer is thicker than 2 mm. For example, a thickness of the frost layer is 2.2 mm, 2.5 mm, 2.8 mm, 3.0 mm, 3.5 mm, 4.0 mm, 4.5 mm, or 5.0 mm.

The refrigerant discharged from the first exhaust port 12 of the compressor 1 enters the first heat exchanger 3 from the refrigerant inlet 31 of the first heat exchanger 3.

The refrigerant entering the first heat exchanger 3 absorbs the heat of the hot water in the first heat exchanger 3, so that the temperature of the refrigerant increases.

In S200', the controller 400 opens at least one of the first throttling device 6, the first control valve 9, or the second control valve 21.

When the controller 400 opens at least the first throttling device 6 and the first control valve 9, the above S200' includes steps S210' and S220', and S220' includes steps S221' to S223'. S200', S210' and S220', and S221' to S223' here are the same as S200, S210 and S220, and S221 to S223 in FIG. 8, respectively, and will not be repeated.

In S300', the controller 400 turns the water pump 10 on.

The controller 400 controls the water pump 10 to turn on, and the water pump 10 introduces the water in the water tank 300 into the first heat exchanger 3 through the hot water supply pipe 202, thereby speeding up an efficiency of the refrigerant in the first heat exchanger 3 to absorb the heat of the water, and shortening the defrosting duration.

That the controller 400 turns the water pump 10 on in S300' includes steps 310' and 320' (S310' and S320').

In S310', the controller 400 controls the water pump 10 to turn on at a preset rotation rate.

The controller 400 inputs a voltage signal with a preset duty cycle to the water pump 10 to turn on the water pump 10 at the preset rotation rate. The preset duty cycle of the voltage signal applied to the water pump 10 is in a range of, for example, 50% to 65%, inclusive; for example, the preset duty cycle of the voltage signal of the water pump 10 is 50%, 52%, 55%, 60%, 62%, or 65%.

In S320', the controller 400 adjusts a rotation rate of the water pump 10 to a target rotation rate according to a discharge temperature of the compressor 1 and the temperature at the refrigerant outlet 32 of the first heat exchanger 3.

In some embodiments, the rotation rate of the water pump 10 is inversely proportional to the duty cycle of the voltage signal for controlling the rotation rate of the water pump 10, and the duty cycle of the voltage signal is adjusted to adjust the rotation rate of the water pump 10 to the target rotation speed. For example, the larger the duty cycle of the voltage signal applied to the water pump 10 is, the lower the rotation rate of the water pump 10 is; and the smaller the duty cycle of the voltage signal applied to the water pump 10 is, the greater the rotation rate of the water pump 10 is.

In some embodiments, the target rotation rate of the water pump 10 corresponds to a target duty cycle PWM(n) of the voltage signal. The target duty cycle PWM(n) of the voltage signal satisfies a formula: $PWM(n)=PWM(n-1)+\Delta PWM$. PWM(n−1) is a current duty cycle of the voltage signal of the water pump 10, and ΔPWM is a duty cycle correction value of the voltage signal of the water pump 10 caused by the discharge temperature $T_d$ of the compressor 1 and the temperature $T_{gc}$ of the refrigerant at the refrigerant outlet 32 of the first heat exchanger 3. The duty cycle correction value ΔPWM of the voltage signal of the water pump 10 may be obtained by looking up a table. For example, Table 1 shows the duty cycle correction value of the voltage signal of the water pump 10 determined according to the discharge temperature $T_d$ of the compressor 1 and the temperature $T_{gc}$ of the refrigerant at the refrigerant outlet 32 of the first heat exchanger 3.

TABLE 1

Duty Cycle Correction Value ΔPWM of the Voltage Signal of the Water Pump 10

| $T_{gc}$ | $T_d$ | | | |
|---|---|---|---|---|
| | $T_d \leq 30°$ C. | $30° C. < T_d \leq 40°$ C. | $40° C. < T_d \leq 50°$ C. | $T_d > 50°$ C. |
| $T_{gc} \leq 30°$ C. | −6% | −5% | −4% | −3% |
| $30° C. < T_{gc} \leq 40°$ C. | −4% | −3% | −2% | −1% |
| $40° C. < T_{gc} \leq 50°$ C. | −2% | −1% | 0% | 1% |
| $T_{gc} > 50°$ C. | 0% | 0% | 0% | 0% |

The controller 400 obtains the discharge temperature $T_d$ at the first exhaust port 12 of the compressor 1 detected by the exhaust temperature sensor 18 and the temperature $T_{gc}$ of the refrigerant at the refrigerant outlet 32 of the first heat exchanger 3 detected by the refrigerant outlet temperature sensor 35. According to the obtained temperatures, corresponding correction value ΔPWM of the duty cycle of the voltage signal of the water pump 10 is looked up in Table 1, so that the current duty cycle of the voltage signal of the water pump 10 is adjusted to the target duty cycle of the voltage signal, and then the rotation rate of the water pump is adjusted to the target rotation rate.

For example, when the exhaust temperature $T_d$ at the first exhaust port 12 of the compressor 1 is greater than 30° C. and is less than or equal to 40° C., and the temperature $T_{gc}$ of the refrigerant is greater than 40° C. and is less than or equal to 50° C., the target duty cycle PWM(n) of the voltage signal of the water pump 10 is equal to the current duty cycle PWM(n−1) of the voltage signal of the water pump 10 plus −1%.

In some embodiments, an order of S200' and S300' may be exchanged; for example, S300' is performed before S200'.

In S400', when the controller 400 determines that the $CO_2$ heat pump system 1000 reaches a second defrosting completion condition, the waterway control valve 204 controls the water inlet 33 of the first heat exchanger 3 to disconnect from the hot water supply pipe 202.

In some embodiments, the second defrosting completion condition is that the temperature $T_g$ of the main gas tube of the evaporator 7 is greater than or equal to the second preset gas tube temperature. The second preset gas tube temperature is in a range of, for example, 7° C. to 8.2° C., inclusive; for example, the second preset gas tube temperature is 7° C., 7.2° C., 7.5° C., 8° C., or 8.2° C.

The controller 400 obtains the temperature $T_g$ of the main gas tube of the evaporator 7 detected by the gas tube temperature sensor 73, and determines whether the temperature $T_g$ at the main gas tube of the evaporator 7 is greater than or equal to the second preset gas tube temperature. In a case where the temperature $T_g$ at the main gas tube of the evaporator 7 is greater than or equal to the second preset gas tube temperature, the controller 400 controls the waterway control valve 204 to control the water inlet 33 of the first heat exchanger 3 to disconnect from the hot water supply pipe 202, and the frosting ends.

For example, in a case where the second preset gas tube temperature is 8° C., the second defrosting completion condition is that the temperature $T_g$ of the main gas tube of the evaporator 7 is greater than or equal to 8° C.

In some embodiments, as shown in FIG. 1A, in a case where the $CO_2$ heat pump system 1000 includes the plurality of heat pump sub-systems, the defrosting control method of the $CO_2$ heat pump system 1000 further includes steps S500' to S800'. The S500' to S800' here are the same as the S400 to S700 in FIG. 8, respectively, and will not be repeated.

In the description of the specification, specific features, structures, materials, or characteristics may be combined in any suitable manner in any one or more embodiments or examples.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. An air source heat pump system, comprising at least one heat pump sub-system and at least one water tank, and the at least one heat pump sub-system being connected to the at least one water tank;

each heat pump sub-system including:

a refrigerant circulation path including a compressor, a first heat exchanger, a first throttling device, and an evaporator that are connected to one another in sequence, and a refrigerant used in the refrigerant circulation path being $CO_2$; and a water supply circulation path including a first supply pipe, a second supply pipe, a return pipe, and a waterway control valve, the first supply pipe and the second supply pipe being each communicated with an end of the first heat exchanger through the waterway control valve, and the return pipe being communicated with another end of the first heat exchanger; wherein, each water tank includes a water inlet and a water outlet;

the return pipe is communicated with the water inlet of a corresponding water tank, and the second supply pipe is communicated with the water outlet of the corresponding water tank;

the compressor includes a first suction port and a first exhaust port;

the first heat exchanger further includes a refrigerant inlet and a refrigerant outlet;

the evaporator includes a gas inlet and a gas outlet; and the first exhaust port is connected to the refrigerant inlet, the refrigerant outlet is connected to the gas inlet of the evaporator, and the gas outlet of the evaporator is connected to the first suction port;

the air source heat pump system further comprising: a first control valve and a bypass pipeline; wherein the first control valve is disposed on the bypass pipeline and located between the refrigerant outlet of the first heat exchanger and the gas inlet of the evaporator; and the first control valve is connected in parallel with the first throttling device;

wherein the air source heat pump system is used to defrost the evaporator;

the refrigerant is discharged from the first exhaust port of the compressor and enters the first heat exchanger through the refrigerant inlet of the first heat exchanger, and the refrigerant entering the first heat exchanger absorbs heat of water in the first heat exchanger, so that temperature of the refrigerant increases; and the first throttling device and the first control valve are opened, and the refrigerant is discharged from the refrigerant outlet of the first heat exchanger and enters the evaporator through the first control valve and the first throttling device, respectively, to defrost the evaporator; or, only the first control valve is opened, and the refrigerant is discharged from the refrigerant outlet of the first heat exchanger and enters the evaporator through the first control valve to defrost the evaporator;

the air source heat pump system further comprising: a heat absorber, a second control valve, and a heat absorption branch; wherein the heat absorption branch is located between the refrigerant outlet of the first heat exchanger and the gas inlet of the evaporator, and is disposed in parallel with the first throttling device;

the second control valve is located on the heat absorption branch, and is configured to control opening or closing of the heat absorption branch; and the heat absorber is located on the heat absorption branch and on a connecting pipe between the first exhaust port of the compressor and the refrigerant inlet, and is configured to absorb heat of the refrigerant at the first exhaust port.

2. The air source heat pump system according to claim 1, wherein the first heat exchanger includes a water inlet and a water outlet;

the first supply pipe and the second supply pipe are each connected to the water inlet of the first heat exchanger through the waterway control valve, and the return pipe is connected to the water outlet of the first heat exchanger; and the waterway control valve is configured to control the water inlet of the first heat exchanger to communicate with the first supply pipe and to disconnect from the second supply pipe; or to control the water inlet of the first heat exchanger to disconnect from the first supply pipe and to communicate with the second supply pipe; or to control the water inlet of the first heat exchanger to disconnect from both the first supply pipe and the second supply pipe.

3. The air source heat pump system according to claim 2, further comprising a water pump; wherein the water pump is located between the waterway control valve and the water inlet of the first heat exchanger, and is configured to drive water to flow.

4. The air source heat pump system according to claim 1, further comprising a gas-liquid separator located between the evaporator and the compressor; wherein the gas-liquid separator includes a gas inlet and a gas outlet, the gas inlet of the gas-liquid separator is connected to the gas outlet of the evaporator, and the gas outlet of the gas-liquid separator is connected to the first suction port of the compressor.

5. The air source heat pump system according to claim 1, wherein a valve bore of the first control valve when the first control valve is fully opened is greater than a valve bore of the first throttling device when the first throttling device is fully opened; and a valve bore of the second control valve when the second control valve is fully opened is less than the valve bore of the first throttling device when the first throttling device is fully opened.

6. A defrosting control method applied to the air source heat pump system according to claim 5, wherein the air source heat pump system further includes a controller, and the first heat exchanger further includes a water inlet and a water outlet; and the defrosting control method comprises:

in response to determining, by the controller, that the air source heat pump system reaches a defrosting condition, controlling, by the waterway control valve, the water inlet of the first heat exchanger to disconnect from both the first supply pipe and the second supply pipe, so that a defrosting of the evaporator is started; and in a case where determining, by the controller, that the air source heat pump system reaches a defrosting completion condition, the defrosting ending.

7. The defrosting control method according to claim 6, wherein the defrosting condition includes:

an ambient temperature of the air source heat pump system being greater than or equal to a first preset ambient temperature, and a temperature of a main fluid pipe of the evaporator being less than or equal to a first preset fluid pipe temperature and being greater than a second preset fluid pipe temperature; or the ambient temperature of the air source heat pump system being greater than a second preset ambient temperature and being less than the first preset ambient temperature, and the temperature of the main fluid pipe of the evaporator being less than or equal to a temperature difference between the ambient temperature and a first preset temperature and being greater than a temperature difference between the ambient temperature and a second preset temperature; or the ambient temperature of the air source heat pump system being less than or equal to the second preset ambient temperature, and the temperature of the main fluid pipe of the evaporator being less than or equal to a temperature difference between the ambient temperature and a third preset temperature and being greater than a temperature difference between the ambient temperature and a fourth preset temperature; or a suction pressure of the compressor being less than or equal to a first preset pressure and being greater than a second preset pressure, and a duration during which the suction pressure of the compressor is less than or equal to the first preset pressure and is greater than the second preset pressure reaching a first preset duration; and the defrosting completion condition includes:

a temperature of a main gas tube of the evaporator being greater than or equal to a first preset gas tube temperature; or a defrosting duration of the air source heat pump system being greater than or equal to a second preset duration.

8. The defrosting control method according to claim 7, after the controller determines that the air source heat pump system reaches the defrosting condition and before the defrosting ends, the defrosting control method further comprises:

opening, by the controller, at least one of the first throttling device, the first control valve, or the second control valve.

9. The defrosting control method according to claim 8, wherein opening, by the controller, at least one of the first throttling device, the first control valve, or the second control valve includes:

opening, by the controller, the first throttling device with a preset opening degree, and opening, by the controller, the first control valve with a maximum opening degree; and adjusting, by the controller, an opening degree of the first throttling device to a target opening degree according to a suction superheat degree of the compressor.

10. The defrosting control method according to claim 9, wherein adjusting, by the controller, the opening degree of the first throttling device to the target opening degree according to the suction superheat degree of the compressor includes:

in a case where the controller determines that the suction superheat degree of the compressor is greater than a preset suction superheat degree, reducing, by the controller, the opening degree of the first throttling device to the target opening degree;

in a case where the controller determines that the suction superheat degree of the compressor is less than the preset suction superheat degree, increasing, by the controller, the opening degree of the first throttling device to the target opening degree;

in a case where the controller determines that a duration during which the first throttling device maintains the target opening degree reaches a control period, redetermining, by the controller, a relationship between the suction superheat degree of the compressor and the preset suction superheat degree;

the preset suction superheat degree being a difference obtained by subtracting a refrigerant saturation temperature corresponding to the suction pressure from a suction temperature of the compressor; and the target opening degree being an opening degree of the first throttling device when the suction superheat degree of the compressor is equal to the preset suction superheat degree.

11. The defrosting control method according to claim 6, wherein the air source heat pump system includes a plurality of heat pump sub-systems, and the defrosting control method further comprises one of the following:

in a case where the controller determines that a total number of heat pump sub-systems that need to be defrosted is less than or equal to a maximum defrosting number, controlling, by the controller, the heat pump sub-systems that need to be defrosted to be defrosted synchronously;

or in a case where the controller determines that the total number of heat pump sub-systems that need to be defrosted is greater than the maximum defrosting number, controlling, by the controller, at least one of the heat pump sub-systems that need to be defrosted to be defrosted first;

after a defrosting of the at least one heat pump sub-system is completed, judging, by the controller, whether the total number of remaining heat pump sub-system to be defrosted is greater than the maximum defrosting number;

in a case where the controller determines that the total number of remaining heat pump sub-systems that need to be defrosted is greater than the maximum defrosting number, controlling, by the controller, at least one of the remaining heat pump sub-systems that need to be defrosted to be defrosted; and in a case where the controller determines that a total number of remaining heat pump sub-systems that need to be defrosted is less than or equal to the maximum defrosting number, controlling, by the controller, all the remaining heat pump sub-systems that need to be defrosted to be defrosted synchronously.

12. A defrosting control method applied to the air source heat pump system according to claim 5, wherein the air source heat pump system further includes a controller, and the first heat exchanger further includes a water inlet and a water outlet; and the defrosting control method further comprises:

in response to determining, by the controller, that the air source heat pump system reaches a defrosting condition, controlling, by the waterway control valve, the water inlet of the first heat exchanger to communicate with the second supply pipe and to disconnect from the first supply pipe, so that a defrosting of the evaporator is started; and in a case where determining, by the controller, that the air source heat pump system reaches a defrosting completion condition, controlling, by the waterway control valve, the water inlet of the first heat exchanger to disconnect from the second supply pipe.

13. The defrosting control method according to claim 12, wherein the defrosting condition includes:

an ambient temperature of the air source heat pump system being greater than or equal to a first preset ambient temperature, and a temperature of a main fluid pipe of the evaporator being less than or equal to a second preset fluid pipe temperature; or the ambient temperature of the air source heat pump system being greater than a second preset ambient temperature and being less than the first preset ambient temperature, and the temperature of the main fluid pipe of the evaporator being less than or equal to a temperature difference between the ambient temperature and a second preset temperature; or the ambient temperature of the air source heat pump system being less than or equal to the second preset ambient temperature, and the temperature of the main fluid pipe of the evaporator being less than or equal to a temperature difference between the ambient temperature and a fourth preset temperature; or a suction pressure of the compressor being less than or equal to a second preset pressure, and a duration during which the suction pressure of the compressor is less than or equal to the second preset pressure reaching a first preset duration; and the defrosting completion condition includes:

the temperature of the main gas tube of the evaporator being greater than or equal to a second preset gas tube temperature.

14. The defrosting control method according to claim 12, wherein the air source heat pump system further includes a water pump; and after the controller determines that the air source heat pump system reaches the defrosting condition, and before the waterway control valve controls the water inlet of the first heat exchanger to disconnect from the second supply pipe, the defrosting control method further comprises:

turning, by the controller, the water pump on.

15. The defrosting control method according to claim 14, wherein turning, by the controller, the water pump on includes:

controlling, by the controller, the water pump to turn on at a preset rotation rate; and adjusting, by the controller, a rotation rate of the water pump to a target rotation rate according to a discharge temperature of the compressor and a temperature at the refrigerant outlet of the first heat exchanger.

16. The air source heat pump system according to claim 1, further comprising a second heat exchanger; wherein the second heat exchanger includes a first heat exchange flow path and a second heat exchange flow path;

the first heat exchange flow path is disposed between the gas outlet of the evaporator and the first suction port of the compressor; and the second heat exchange flow path is disposed between the refrigerant outlet of the first heat exchanger and the first throttling device.

17. The air source heat pump system according to claim 1, further comprising an economizer, a second throttling device, a third control valve, and a gas supplementing branch; wherein the compressor further includes a second exhaust port, a second suction port, and a gas supplementing port; and the gas supplementing port of the compressor is disposed on a pipe where the second exhaust port and the second suction port of the compressor are communicated;

the economizer includes a third heat exchange flow path and a fourth heat exchange flow path; the third heat exchange flow path is located between the first throttling device and the gas supplementing port of the compressor; and the fourth heat exchange flow path is located between the refrigerant outlet of the first heat exchanger and the first throttling device;

the second throttling device is located between the first throttling device and the third heat exchange flow path;

the third control valve is disposed on the gas supplementing branch and between the third heat exchange flow path and the gas supplementing port of the compressor; and the second throttling device and the third control valve are configured to control opening or closing of the gas supplementing branch.

* * * * *